US010172228B2

(12) United States Patent
Tantawi et al.

(10) Patent No.: US 10,172,228 B2
(45) Date of Patent: Jan. 1, 2019

(54) APPARATUS FOR MM-WAVE RADIATION GENERATION UTILIZING WHISPERING GALLERY MODE RESONATORS

(71) Applicant: The Board of Trustees of the Leland Stanford Junior University, Palo Alto, CA (US)

(72) Inventors: Sami G. Tantawi, Stanford, CA (US); Filippos Toufexis, Redwood City, CA (US); Michael V. Fazio, San Carlos, CA (US); Valery A. Dolgashev, San Carlos, CA (US)

(73) Assignee: The Board of Trustees of the Leland Stanford Junior University, Stanford, CA (US)

( * ) Notice: Subject to any disclaimer, the term of this patent is extended or adjusted under 35 U.S.C. 154(b) by 43 days.

(21) Appl. No.: 15/675,690

(22) Filed: Aug. 11, 2017

(65) Prior Publication Data

US 2017/0367171 A1 Dec. 21, 2017

Related U.S. Application Data

(63) Continuation of application No. 15/588,002, filed on May 5, 2017, now abandoned.

(60) Provisional application No. 62/332,390, filed on May 5, 2016.

(51) Int. Cl.

| | |
|---|---|
| ***H05H 9/02*** | (2006.01) |
| ***H05H 7/22*** | (2006.01) |
| *H05H 7/08* | (2006.01) |

(52) U.S. Cl.
CPC ..... *H05H 9/02* (2013.01); *H05H 7/08* (2013.01); *H05H 7/22* (2013.01); *H05H 2007/084* (2013.01)

(58) Field of Classification Search
CPC ..... G02B 6/29302; G02B 6/29341; G02B 6/29395; H01J 28/78; H01J 25/08; H01J 25/30; H01J 23/20; H05H 7/22; H05H 9/02; H05H 2007/084
See application file for complete search history.

(56) References Cited

U.S. PATENT DOCUMENTS

| | | | | |
|---|---|---|---|---|
| 3,885,193 A | | 5/1975 | Budker | |
| 4,019,088 A | | 4/1977 | Budker | |
| 4,210,845 A | | 7/1980 | Lebacqz | |
| 4,520,293 A | | 5/1985 | Muller | |
| 4,912,367 A | * | 3/1990 | Schumacher | H01J 25/005 313/231.31 |
| 5,263,043 A | * | 11/1993 | Walsh | H01S 3/0903 372/102 |

(Continued)

*Primary Examiner* — Haissa Philogene
(74) *Attorney, Agent, or Firm* — Lumen Patent Firm

(57) ABSTRACT

An apparatus for generating high frequency electromagnetic radiation includes a whispering gallery mode resonator, coupled to an output waveguide through a coupling aperture. The resonator has a guiding surface, and supports a whispering gallery electromagnetic eigenmode. An electron source is configured to generate a velocity vector-modulated electron beam, where each electron in the velocity vector-modulated electron beam travels substantially perpendicular to the guiding surface, while interacting with the whispering gallery electromagnetic eigenmode in the whispering gallery mode resonator, generating high frequency electromagnetic radiation in the output waveguide.

14 Claims, 22 Drawing Sheets

(56) References Cited

U.S. PATENT DOCUMENTS

| | | | | |
|---|---|---|---|---|
| 7,062,131 | B2 * | 6/2006 | Ilchenko | G02B 6/12007 385/28 |
| 9,268,195 | B1 * | 2/2016 | Camacho | G02F 1/3536 |
| 9,703,045 | B2 * | 7/2017 | Evans | G01J 1/4257 |
| 9,741,521 | B1 * | 8/2017 | Perkins | H01J 23/20 |

* cited by examiner

APPARATUS FOR MM-WAVE RADIATION GENERATION UTILIZING WHISPERING GALLERY MODE RESONATORS

FIELD OF THE INVENTION

This invention relates to vacuum tubes for high power microwave and mm-wave generation. More specifically it relates to phase-locked oscillators and frequency multipliers such as Gyrocons and Trirotrons.

BACKGROUND OF THE INVENTION

The mm-wave region of the electromagnetic spectrum (defined herein to mean 30 GHz up to 1 THz) is still unexploited in high-power RF devices, mainly because of the lack of phased-locked sources that are able to provide substantial amount of power. Traditional linear interaction RF sources, such as Klystrons and Traveling Wave Tubes, fail to produce significant power levels at this part of the frequency spectrum. This is because their critical dimensions are small compared to the wavelength, and therefore the amount of beam current that can go through the beam apertures is very limited. There is therefore a need for compact, high power mm-wave sources. These would also enable several additional applications such as basic research, high-resolution medical imaging, navigation through sandstorms, spectroscopic detection of explosives, high bandwidth, low probability of intercept communications, space radars for debris tracking of objects less that 5 cm that present hazards to space assets such as communications satellites, and even human space flight safety in the future.

SUMMARY OF THE INVENTION

The present invention provides a vacuum tube technology, where the device size is inherently bigger than the wavelength it is operating on. It provides an improvement upon the output circuit of Gyrocons (U.S. Pat. No. 3,885,193 and U.S. Pat. No. 4,019,088) and Trirotrons (U.S. Pat. No. 4,210,845 and U.S. Pat. No. 4,520,293) to make them suitable for high power operation with low beam voltage in the mm-wave and THz part of the electromagnetic spectrum. In Gyrocons, an axial DC electron beam, originating from a pierce gun, is helically deflected, by exciting two orthogonal polarizations in a $TM_{11}$ deflecting resonator with a 90° phase difference. The beam arrives at the output resonator as a current wave rotating around the axis of symmetry, and excites a traveling electromagnetic wave. The synchronism condition is given by $\omega_{RF}=n\omega_{LO}$, where $\omega_{LO}$ is the angular frequency of the deflecting resonator, $\omega_{RF}$ is angular frequency of the generated signal in the output resonator, and n is the number of azimuthal variations of the target eigenmode in the output resonator. However, the type of output cavities traditional Gyrocons used employed beam pipes shielded with aluminum foils to contain the fields, thus requiring relativistic electron beams. Additionally, a complicated magnetic field profile was necessary to get the beam through those beam pipes. Scaling those designs to higher frequencies requires reducing the current dramatically, and therefore limiting the output power to levels already achieved with traditional devices. In Trirotrons, an annular radially expanding DC electron beam is radially velocity modulated using a ring resonator operating at $\omega_{LO}$ and is intercepted at an output resonator operating at $\omega_{RF}=n\omega_{LO}$, and having n times the number of azimuthal variation as the modulating resonator. Similarly to Gyrocons, scaling the output resonator of a Trirotron into the mm-wave and THz part of the electromagnetic spectrum requires a very narrow beam pipe and therefore limited current.

In a whispering gallery mode resonator, the electromagnetic waves bounce around a central axis, supported by the guiding surface of the resonator. Because of such a field configuration, the inner part of the resonator can be completely open without the fields leaking, as in a ring resonator. Unlike Gyrocons and Trirotrons, the whispering gallery mode resonator also acts as the collector. When the device is configured for frequency multiplication from X-band (8-12 GHz) to V-band (50-75 GHz) or W-Band (75 GHz-110 GHz), the dimensions of the output resonator allow for a device that is small enough that beam expansion is minimal, even without any focusing magnetic field, but big enough to allow for significant current to go through. There is therefore no need for a narrow beam pipe, or any sort of magnetic focusing or beam guidance compared to existing Gyrocons and Trirotrons.

The present invention provides a device for generating mm-wave radiation, the device including an electron gun emitting an electron beam, a whispering gallery mode resonator, and an output waveguide coupled to the whispering gallery mode resonator.

In one aspect, the invention provides apparatus for generating mm-wave electromagnetic radiation at an output frequency comprising: a) a whispering gallery mode resonator with a guiding surface, wherein the whispering gallery mode resonator has dimensions selected to support a whispering gallery electromagnetic eigenmode at the output frequency, b) an output waveguide coupled to the whispering gallery mode resonator through an apperture, and c) an electron beam source, wherein the electron beam source is designed to generate a velocity vector-modulated electron beam, wherein the electron beam source is configured such that the velocity vector-modulated electron beam travels substantially perpendicular to the guiding surface.

In some embodiments, the whispering gallery mode resonator is a spherical sector, wherein the whispering gallery mode resonator is designed to support two orthogonal whispering gallery eigenmodes with the same output eigenfrequency, wherein the apparatus further comprises a coupler coupling the whispering gallery mode resonator to the output waveguide, wherein the coupler is designed to couple the two orthogonal whispering gallery eigenmodes with a 90 degree phase difference to the output waveguide.

In some embodiments, the whispering gallery mode resonator is a spherical shell on equator, wherein the whispering gallery mode resonator is designed to support two orthogonal whispering gallery eigenmodes having the same output eigenfrequency, wherein the output waveguide is designed to couple the two orthogonal whispering gallery modes with a 90 degree phase difference.

In some embodiments, the whispering gallery mode resonator is a cylindrical wedge, wherein the whispering gallery mode resonator is designed to support two orthogonal whispering gallery eigenmodes having the same output eigenfrequency, wherein the output waveguide is designed to couple the two orthogonal whispering gallery modes with a 90 degree phase difference.

In some embodiments, the output waveguide has a rectangular cross-section with dimensions selected to support only one propagating mode at the output frequency.

In another aspect, the invention provides an apparatus for generating high frequency electromagnetic radiation comprising: a whispering gallery mode resonator, having: an axis of symmetry, a guiding surface, the whispering gallery mode resonator supporting two orthogonal whispering gallery eigenmodes, an output waveguide, wherein the whispering gallery mode resonator is coupled to the output waveguide and configured to couple from the output waveguide the two orthogonal whispering gallery eigenmodes with a 90 degree phase difference an electron beam source configured to generate a velocity vector-modulated electron beam that travels substantially perpendicular to the guiding surface.

In some embodiments, the whispering gallery mode resonator is a spherical sector, wherein the electron beam source is an axial electron gun designed to emit an initially continuous electron beam, the initially continuous electron beam initially travelling on an axis of symmetry and being velocity vector-modulated, wherein the apparatus further comprises a deflecting cavity resonator, the deflecting cavity resonator designed to support two orthogonal deflecting eigenmodes having the same input eigen-frequency, wherein the apparatus further comprises an input waveguide coupled to the deflecting cavity resonator and designed to couple the two orthogonal deflecting eigenmodes with a 90 degree phase difference.

In some embodiments, the whispering gallery mode resonator is a spherical shell resonator on equator, wherein the electron beam source is an annular electron gun designed to emit a continuous planar sheet beam, wherein the annular electron gun is concentric with the spherical shell resonator on equator, wherein the apparatus further comprises an annular velocity modulating resonator concentric with spherical shell resonator on equator and designed to support two orthogonal radially accelerating eigenmodes, wherein the apparatus further comprises an input waveguide coupled to the annular velocity modulating resonator and designed to couple the two orthogonal radially accelerating eigenmodes with a 90 degree phase difference, resulting in a rotating wave in the annular velocity modulating resonator, the rotating wave in the annular velocity modulating resonator having the same angular phase velocity as the rotating wave in the whispering gallery mode resonator.

In some embodiments, the whispering gallery mode resonator is a spherical shell resonator on equator, wherein the electron beam source is an annular RF electron gun concentric with the spherical shell resonator on equator, wherein the annular RF electron gun comprises an annular cathode being part of a annular velocity modulating resonator supporting two orthogonal radially accelerating eigenmodes, wherein the annular velocity modulating resonator is coupled to an input waveguide coupling the two orthogonal radially accelerating eigenmodes with a 90 degree phase difference, resulting in a rotating wave in the annular velocity modulating resonator, the rotating wave in the annular velocity modulating resonator having the same angular phase velocity as the rotating wave in the whispering gallery mode resonator.

In some embodiments, the whispering gallery mode resonator is a cylindrical wedge resonator on equator, wherein the electron beam source is an annular electron gun designed to emit a continuous planar sheet beam, wherein the annular electron gun is concentric with the cylindrical wedge resonator, wherein the apparatus comprises an annular velocity modulating resonator concentric with the cylindrical wedge resonator, wherein the annular velocity modulating resonator is designed to support two orthogonal radially accelerating eigenmodes, wherein the apparatus comprises an input waveguide coupled to the annular velocity modulating resonator and configured to couple the two orthogonal radially accelerating eigenmodes with a 90 degree phase difference, resulting in a rotating wave in the annular velocity modulating resonator, the rotating wave in the annular velocity modulating resonator having the same angular phase velocity as the rotating wave in the whispering gallery mode resonator.

In some embodiments, the whispering gallery mode resonator is a cylindrical wedge resonator on equator, wherein the electron beam source is an annular RF electron gun concentric with the cylindrical wedge resonator, wherein the annular RF electron gun comprises an annular cathode being part of an annular velocity modulating resonator coupled to an input waveguide and designed to support two orthogonal radially accelerating eigenmodes, wherein the annular velocity modulating resonator is coupled to an input waveguide designed to couple the two orthogonal radially accelerating eigenmodes with a 90 degree phase difference, resulting in a rotating wave in the annular velocity modulating resonator, the rotating wave in the annular velocity modulating resonator having the same angular phase velocity as the rotating wave in the whispering gallery mode resonator.

In another aspect, the invention provides an apparatus for generating high frequency electromagnetic radiation comprising: an electron source generating a pencil electron beam, an input waveguide, a deflecting cavity resonator positioned on an axis of symmetry, having beam pipes for the electron beam to enter and exit the deflecting cavity resonator, wherein the deflecting cavity resonator is designed to support two orthogonal deflecting eigenmodes having the same input eigen-frequency, wherein the deflecting cavity resonator is coupled to the input waveguide, wherein the input waveguide couples the two orthogonal deflecting eigenmodes with a 90 degree phase difference, resulting in a rotating wave in the deflecting cavity resonator, an output waveguide, a whispering gallery mode resonator, positioned along the axis of symmetry after the deflecting cavity resonator, wherein the whispering gallery mode resonator has a guiding surface and is designed to support two orthogonal whispering gallery eigenmodes having the same output eigen-frequency, wherein the whispering gallery mode resonator is coupled to the output waveguide, wherein the output waveguide is designed to couple the two orthogonal whispering gallery eigenmodes with a 90 degree phase difference, resulting in a rotating wave in the whispering gallery mode resonator, the rotating wave in the deflecting cavity resonator having the phase velocity as the rotating wave in the whispering gallery mode resonator, an electron beam source designed to produce an initially continuous electron beam, initially travelling on the axis of symmetry, through the deflecting cavity resonator.

In some embodiments, the opening for the electron beam to exit the deflecting cavity resonator is formed by nose cones, wherein the whispering gallery mode resonator is a spherical sector resonator formed between the nose cones and a spherical shell.

In some embodiments, the opening for the electron beam to exit the deflecting cavity resonator is formed by nose cones, wherein the whispering gallery mode resonator is a conical piece of an abstract cross-section shell formed between the nose cones and an abstract surface, symmetric by the axis of symmetry.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

Figure 1:
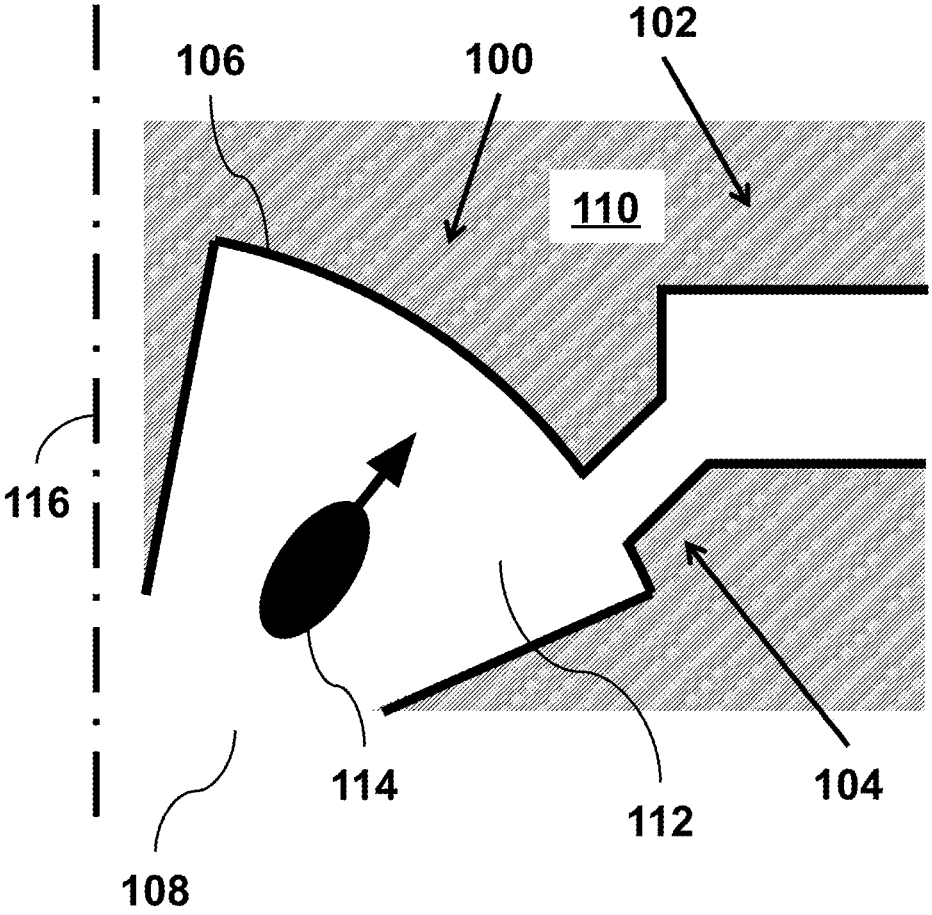
FIG. 1 is a schematic, cross-sectional view of a system for mm-wave radiation generation utilizing whispering gallery mode resonators, according to an embodiment of the invention.

As shown in FIG. 1, an apparatus for generating high frequency electromagnetic radiation according to an embodiment of the invention includes a whispering gallery mode resonator 100 coupled to an output waveguide 102 through a coupling aperture 104. The resonator has a guiding surface 106 and supports a whispering gallery electromagnetic eigenmode. The apparatus also includes a beam entrance opening 108, solid piece of metallic material 110, and inner part of the whispering gallery mode resonator 112. The apparatus is designed so that a velocity vector-modulated electron beam 114, where each electron in the velocity vector-modulated electron beam 114 is travelling substantially perpendicular to the guiding surface 106, while interacting with the whispering gallery electromagnetic eigenmode in the whispering gallery mode resonator 100, generates high frequency electromagnetic radiation in the output waveguide 102.

The apparatus functions to generate high frequency electromagnetic radiation by extracting power from a velocity vector-modulated electron beam 114 inside a whispering gallery mode resonator 100, coupled to an output waveguide 102.

The whispering gallery mode resonator 100 functions to extract energy from the velocity vector-modulated electron beam 114 into high frequency electromagnetic radiation that will be used outside the apparatus. The whispering gallery mode resonator 100 supports a whispering gallery electromagnetic eigenmode that has the dominant electric field vector component in the direction of the velocity vector-modulated electron beam 114 propagation. The velocity vector-modulated electron beam 114 interacts with the whispering gallery electromagnetic eigenmode transferring energy from the electrons into the whispering gallery electromagnetic eigenmode. The whispering gallery electromagnetic eigenmode is supported on a guiding surface 106, that functions to constrain the electromagnetic field inside the whispering gallery mode resonator 100. The guiding surface 106 also functions as the collector of the apparatus, where the velocity vector-modulated electron beam 114 is being dumped at the end of the interaction with the whispering gallery electromagnetic eigenmode. The whispering gallery mode resonator 100 is coupled to an output waveguide 102 through a coupling aperture 104 that functions to transfer electromagnetic energy outside the apparatus.

The whispering gallery mode resonator 100 preferably comprises a guiding surface 106 with some cross section, fully revolved around an axis of symmetry 116. The whispering gallery mode resonator 100 is sized to support the whispering gallery electromagnetic eigenmode at a specific design frequency. This whispering gallery mode resonator 100 supports two degenerate whispering gallery electromagnetic eigenmodes at the same frequency, which are orthogonal to each other. By exciting the degenerate whispering gallery electromagnetic eigenmodes with a 90° phase difference, a rotating or circularly polarized wave is excited. Embodiments may include a number of coupling apertures. Each aperture 104 couples the whispering gallery mode resonator 100 to an output waveguide 102. Each coupling aperture 104 is positioned and sized to allow for a specific design percentage of the extracted energy from the electrons to be radiated inside the output waveguide 102.

Figure 2:
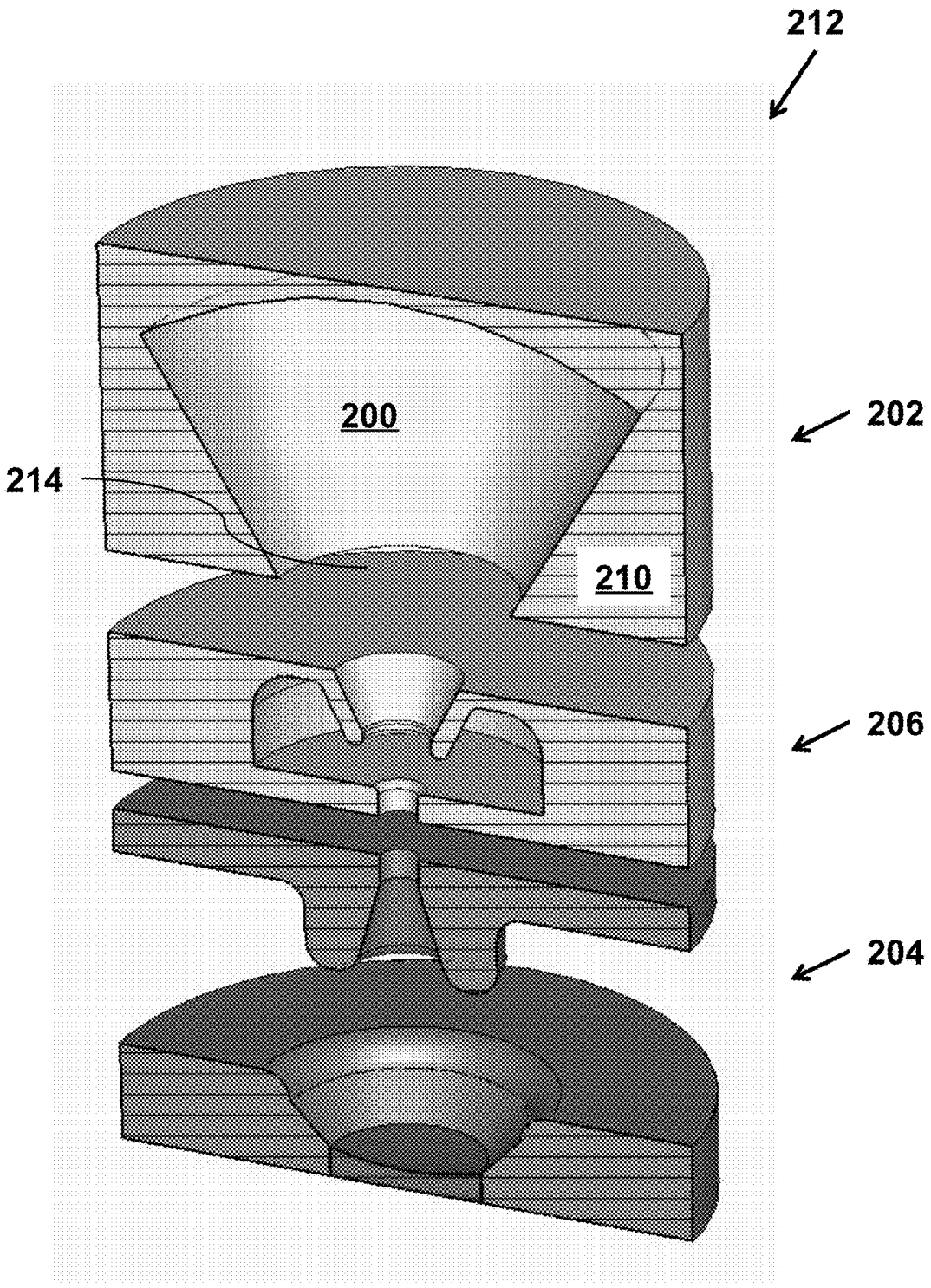
FIG. 2 is a cross-sectional view of a system for frequency multiplication using a spherical sector output resonator, according to an embodiment of the invention.

FIG. 2 shows a preferred embodiment of the invention, implementing frequency multiplication apparatus 212. The apparatus may include an axial electron gun 204 and deflecting resonator 206. The whispering gallery mode resonator is implemented in this embodiment as a spherical sector output resonator 202. The boundaries of the whispering gallery mode resonator are preferably formed by a solid piece of metallic material 210, while the inner part of the whispering gallery mode resonator 200 is evacuated space. The solid piece of metallic material 210 is preferably made of Oxygen-Free, Electronic-Grade Copper, Molybdenum, or Glidcop.

A continuous helically deflected electron beam interacts with the spherical sector resonator 202. As the beam travels in the radial direction in spherical coordinates, helically deflected, the effect of space charge gets reduced. Additionally, since the frequency context is not encoded as longitudinal bunching, but as a rotational current wave, space charge is not limiting any more, in contrast to devices like klystrons or Travelling Wave Tubes. At millimeter wavelengths the dimensions of this resonator allow for a device that is small enough that beam expansion is minimal, even without any focusing magnetic field, but big enough to allow for significant current to go through. There is therefore no need for a narrow beam pipe, or any sort of magnetic focusing or beam guidance compared to gyrocons.

The electron beam originates from an axial electron gun 204 and is preferably circularly deflected by a deflecting resonator 206. The frequency multiplication apparatus 212 preferably comprises an axial electron gun 204 generating an electron beam, a whispering gallery mode resonator 202 output resonator sized to support two orthogonal eigenmodes at the output frequency of interest $f_{out}$, a deflecting resonator 206 sized to support two orthogonal eigenmodes at the m-th subharmonic of the output frequency of interest $$f_{in} = \frac{f_{out}}{m}.$$

As will be discussed elsewhere, embodiments may also include input and output waveguides.

Figure 3:
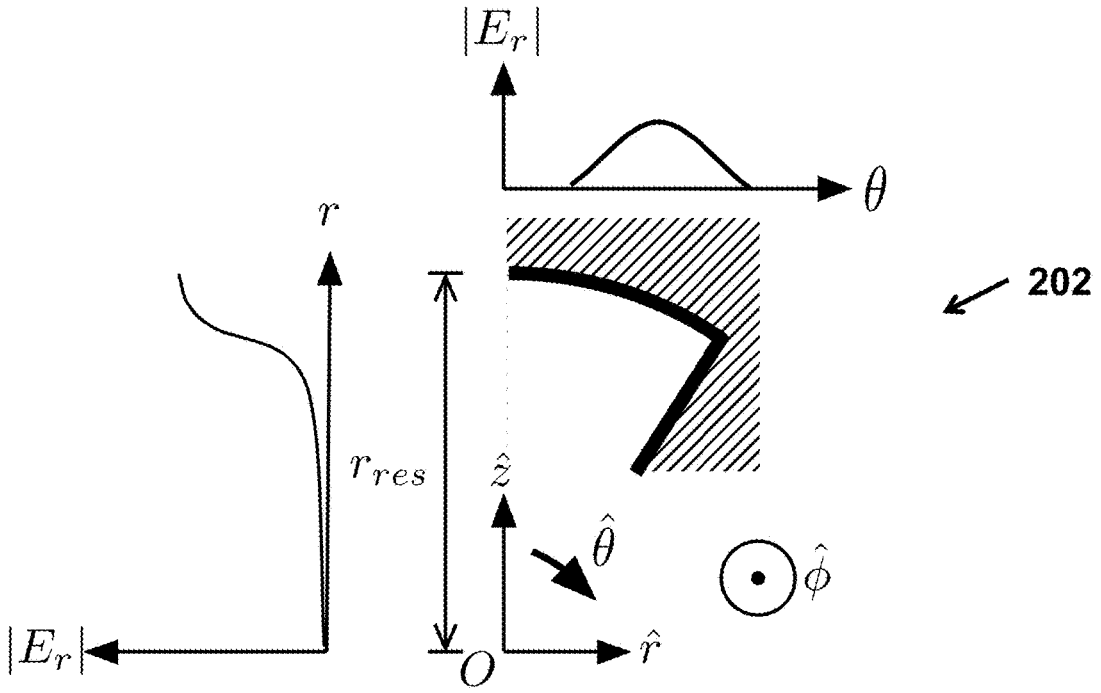
FIG. 3 is a schematic diagram illustrating the field profile in a spherical sector output resonator, according to the embodiment of FIG. 2.

FIG. 3 illustrates the field profile of spherical sector output resonator 202. The electromagnetic field components of the eigenmodes of interest are described by the following equations:

$$E_r = jk_oZ_oP_n^m(\cos\theta)\left[\hat{J}_n(k_or) + \frac{\partial^2}{\partial r^2}\hat{J}_n(k_or)\right]e^{jm\phi} \tag{1a}$$

$$E_\phi = -mZ_oP_n^m(\cos\theta)\frac{\partial}{\partial r}\hat{J}_n(k_or)\frac{e^{jm\phi}}{r\sin\theta} \tag{1b}$$

$$E_\theta = -jmZ_o[(n+1)P_n^m(\cos\theta) + (m-n-1)P_{n+1}^m(\cos\theta)]\frac{\partial}{\partial r}\hat{J}_n(k_or)\frac{e^{jm\phi}}{r\sin\theta} \tag{1c}$$

$$H_r = 0 \tag{1d}$$

$$H_\phi = [(n+1)P_n^m(\cos\theta) + (m-n-1)P_{n+1}^m(\cos\theta)]\hat{J}_n(k_or)\frac{e^{jm\phi}}{r\sin\theta} \tag{1e}$$

$$H_\theta = jmP_n^m(\cos\theta)\hat{J}_n(k_or)\frac{e^{jm\phi}}{r\sin\theta} \tag{1f}$$

Where $\hat{J}_n(x) = \sqrt{\frac{\pi}{2x}}\,J_{n+1/2}(x)$ is the spherical bessel function, $P_n^m(\cos\theta)$ is the associated legendre polynomial, m is the number of azimuthal variations, n is the order of the Legendre Polynomial, $$k_o = \frac{2\pi f_{RF}}{c},$$

$f_{RF}$ is the eigenmode frequency of the resonator, $Z_o$ is the free-space impedance, $$k_o = \frac{\chi'_{n,1}}{r_{res}},$$

$\chi'_{n,1}$ is the first zero of the derivative of the spherical bessel function of order n. When n is large, the field profile decays fast with decreasing r, because of the bessel function. There is no need for an inner conductive surface, and the mode can be supported by only the surfaces shown in FIG. 3. As shown in FIG. 2, this embodiment preferably has a larger than quarter wavelength beam entrance opening 214, which functions as the entrance for the velocity vector-modulated electron beam.

Figure 4:
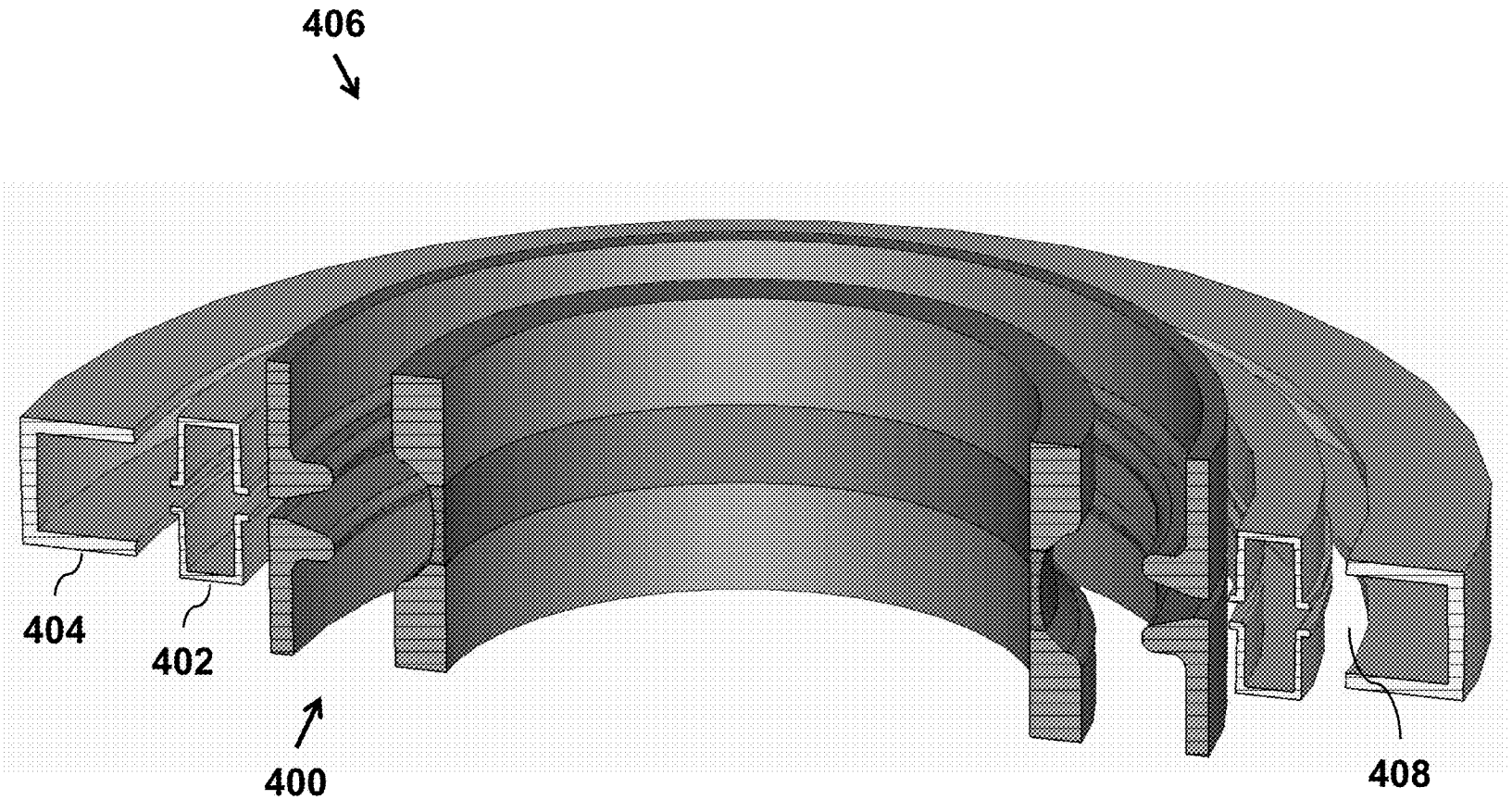
FIG. 4 is a cross-sectional view of the system for frequency multiplication using a cylindrical wedge output resonator, according to an embodiment of the invention.
Figure 5:
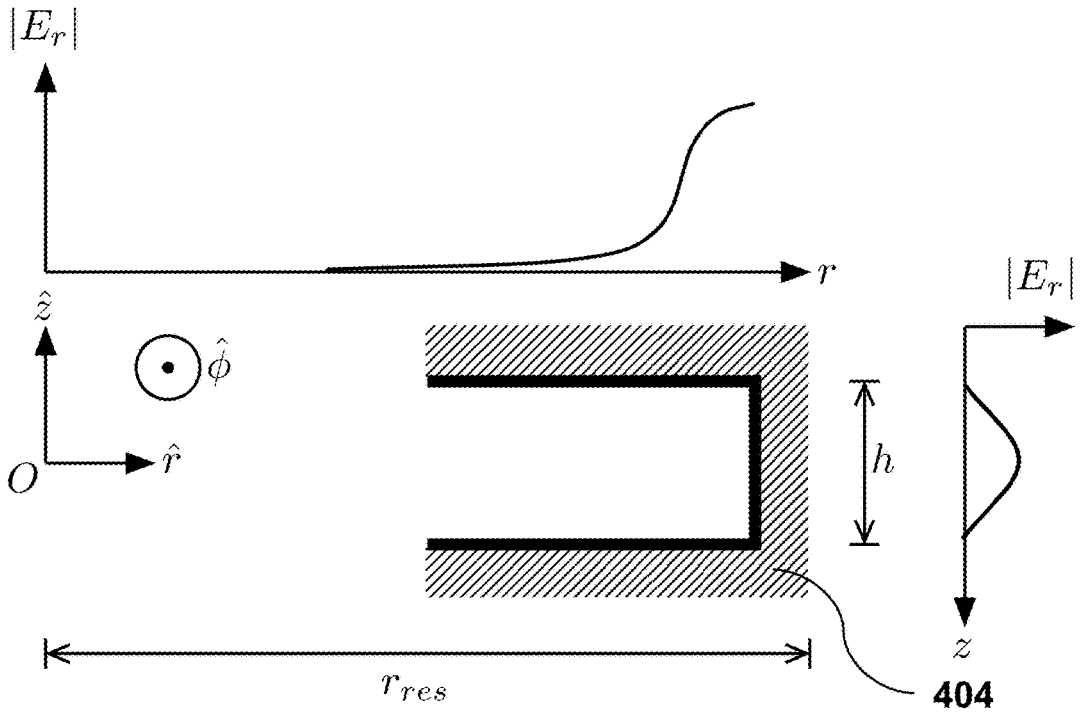
FIG. 5 is a schematic representation of the field profile in a cylindrical wedge output resonator, according to the embodiment of FIG. 4.

As shown in FIG. 4, another embodiment implementing a frequency multiplication apparatus 406 may include an annular electron gun 400 and annular ring resonator 402. The whispering gallery mode resonator in this embodiment may be implemented as a cylindrical wedge output resonator 404. FIG. 5 illustrates the cross-section of output resonator 404. The electromagnetic field components of the eigenmodes of interest are described by the following equations:

$$E_r = -j\frac{n}{r}J_n(k_rr)\cos(k_zz)e^{jn\phi} \tag{2a}$$

$$E_\phi = \frac{1}{2}k_r[J_{n-1}(k_rr) - J_{n+1}(k_rr)]\cos(k_zz)e^{jn\phi} \tag{2b}$$

$$E_z = 0 \tag{2c}$$

$$H_r = j\frac{k_rk_z}{2k_oZ_o}[J_{n+1}(k_rr) - J_{n-1}(k_rr)]\sin(k_zz)e^{jn\phi} \tag{2d}$$

$$H_\phi = \frac{nk_z}{rk_oZ_o}J_n(k_rr)\sin(k_zz)e^{jn\phi} \tag{2e}$$

$$H_z = j\frac{k_o^2 - k_z^2}{k_oZ_o}J_n(k_rr)\cos(k_zz)e^{jn\phi} \tag{2f}$$

Where n is the number of azimuthal variations, $$k_o = \frac{2\pi f_{RF}}{c},$$

$f_{RF}$ is the eigenmode frequency of the resonator, $Z_o$ is the free-space impedance, $$k_z = \frac{\pi}{h},\ k_r = \frac{\chi'_{n,1}}{r_{res}},$$

$\chi'_{n,1}$ is the first zero of the derivative of the bessel function of order n, and $k_o^2 = k_z^2 + k_r^2$. When n is large, the field profile decays fast with decreasing r, because of the bessel function.

There is no need for an inner conductive surface, and the mode can be supported by only the surfaces shown in FIG. 5. As shown in FIG. 4, this embodiment preferably has a larger that quarter wavelength beam entrance opening 408, which functions as the entrance for the velocity vector-modulated electron beam.

Figure 6:
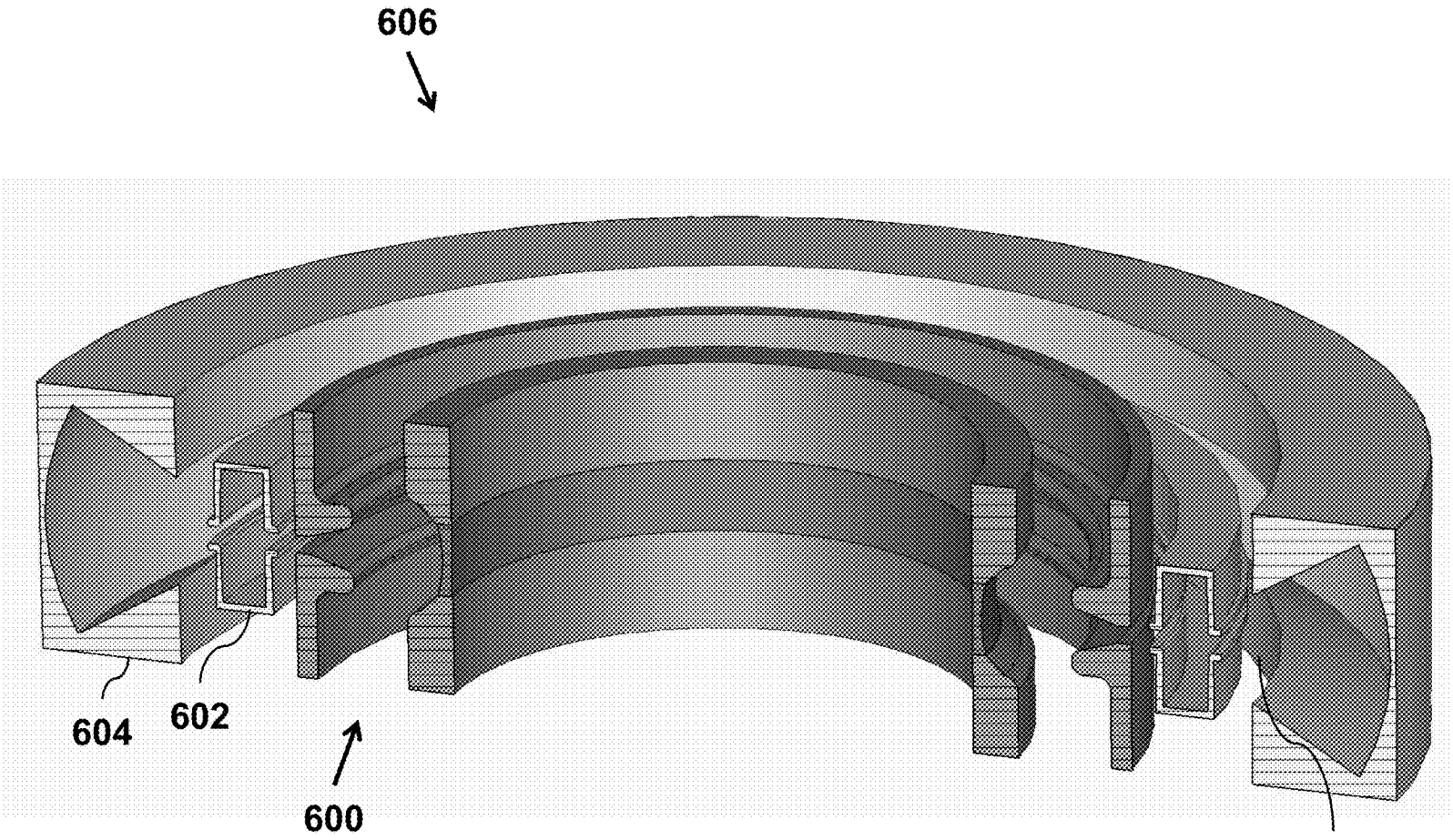
FIG. 6 is a cross-sectional view of the system for frequency multiplication using a spherical shell on equator output resonator, according to an embodiment of the invention.
Figure 7:
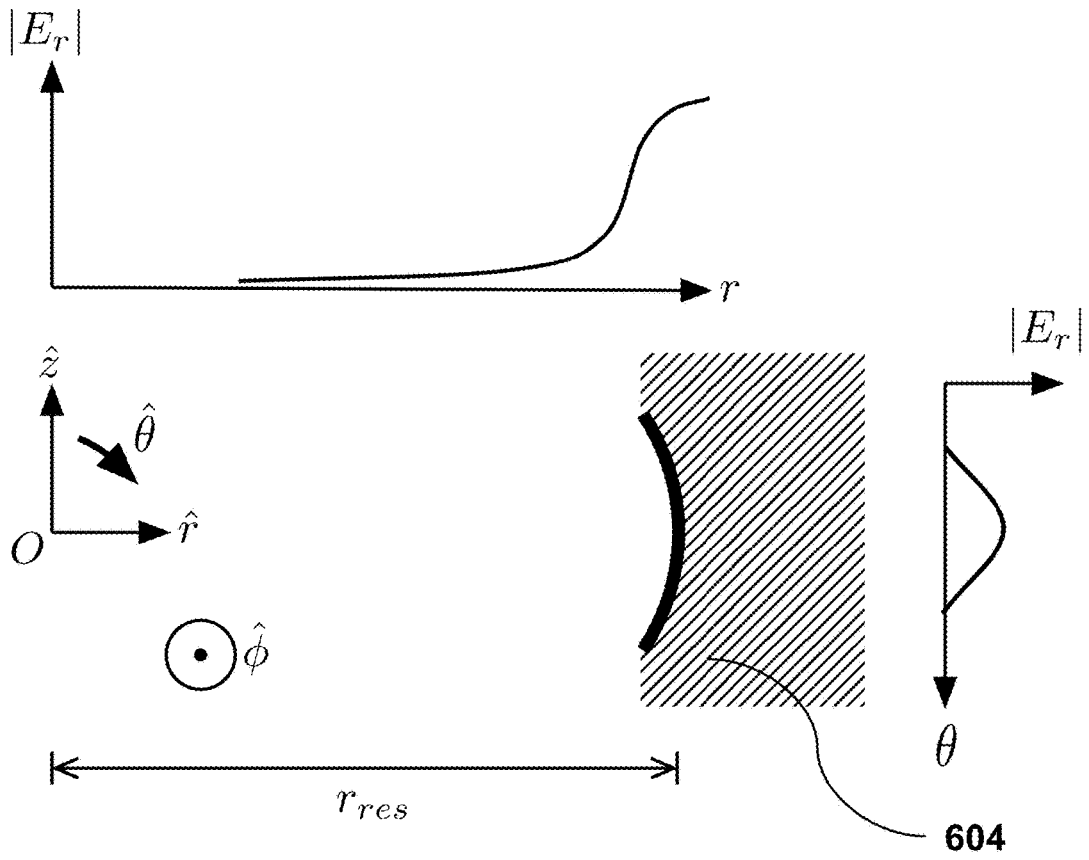
FIG. 7 is a schematic representation of the field profile in a spherical shell on equator output resonator, according to the embodiment of FIG. 6.

As shown in FIG. 6, another embodiment implementing a frequency multiplication apparatus 606 may include an annular electron gun 600 and annular ring resonator 602. The whispering gallery mode resonator here is implemented as a spherical shell on equator resonator 604. FIG. 7 shows details of resonator 604. The electromagnetic field components of the eigenmodes of interest are described by the following equations:

$$E_r = jk_oZ_o\sin^n\theta\left[\hat{J}_n(k_or) + \frac{\partial^2}{\partial r^2}\hat{J}_n(k_or)\right]e^{jn\phi} \tag{3a}$$

$$E_\phi = -nZ_o\sin^{n-1}\theta\frac{\partial}{\partial r}\hat{J}_n(k_or)\frac{e^{jn\phi}}{r} \tag{3b}$$

$$E_\theta = jnZ_o\cos\theta\sin^{n-1}\theta\frac{\partial}{\partial r}\hat{J}_n(k_or)\frac{e^{jn\phi}}{r} \tag{3c}$$

$$H_r = 0 \tag{3d}$$

$$H_\phi = H_\phi = -n\cos\theta\sin^{n-1}\theta\hat{J}_n(k_or)\frac{e^{jn\phi}}{r} \tag{3e}$$

$$H_\theta = jn\sin^{n-1}\theta\hat{J}_n(k_or)\frac{e^{jn\phi}}{r} \tag{3f}$$

$$\text{Where } \hat{J}_n(x) = \sqrt{\frac{\pi}{2x}}\,J_{n+1/2}(x)$$

is the spherical bessel function, n is the number of azimuthal variations, $$k_o = \frac{2\pi f_{RF}}{c},$$

$f_{RF}$ is the eigenmode frequency of the resonator, $Z_o$ is the free-space impedance, $$k_o = \frac{\chi'_{n,1}}{r_{res}},$$

$\chi'_{n,1}$ is the first zero of the derivative of the spherical bessel function of order n. When n is large, the field profile decays fast with decreasing r, because of the bessel function. There is no need for an inner conductive surface, and the mode can be supported by the surfaces shown in FIG. 6. As shown in FIG. 6, this embodiment preferably has a larger that quarter wavelength beam entrance opening 608, which functions as the entrance for the velocity vector-modulated electron beam.

The electron beam preferably originates from an annular electron gun 600 and is preferably velocity-modulated by an annular ring resonator 602. As shown in FIG. 6, the frequency multiplication apparatus 606 preferably comprises an annular electron gun 600 generating an electron beam, a whispering gallery mode resonator 604 output resonator sized to support two orthogonal eigenmodes at the output frequency of interest $f_{out}$, an annular ring resonator 602 sized to support two orthogonal eigenmodes at the m-th subharmonic of the output frequency of interest $$f_{in} = \frac{f_{out}}{m}.$$

As illustrated elsewhere, whispering gallery mode resonator 604 is coupled to an output waveguide, and annular ring resonator 602 is coupled to an input waveguide.

Figure 8:
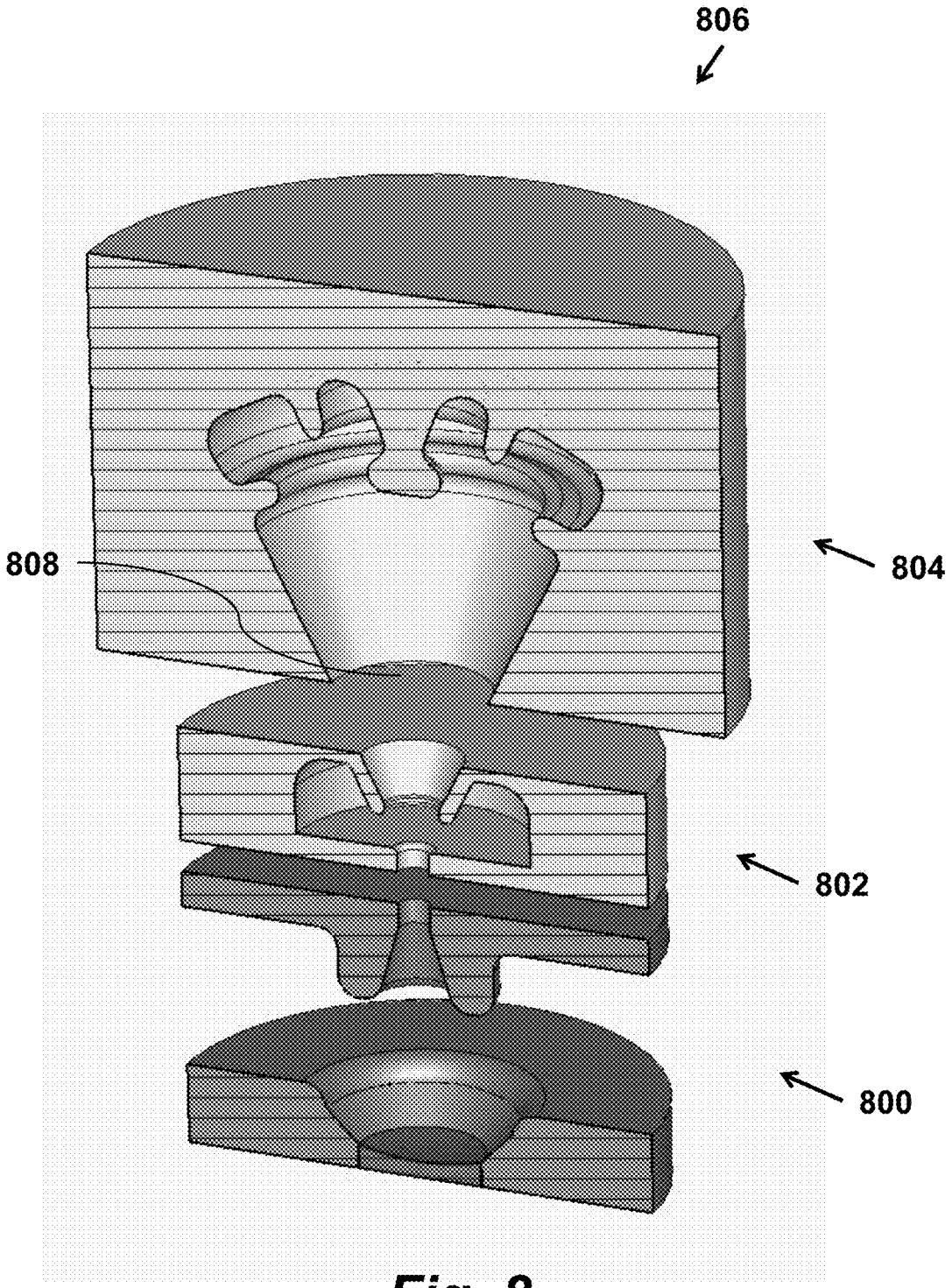
FIG. 8 is a cross-sectional view of the system for frequency multiplication using an arbitrary cross section output resonator, according to an embodiment of the invention.

As shown in FIG. 8, another embodiment configured as a frequency multiplication apparatus 806 may include an axial electron gun 800 and a deflecting resonator 802. The whispering gallery mode resonator here is implemented as an arbitrary cross section resonator 804. The electromagnetic fields in this type of resonator can be analyzed using computer electromagnetic simulation. The exact shape of this type of whispering gallery mode resonator is numerically optimized to maximize the efficiency of the power transfer between the velocity vector-modulated electron beam and the whispering gallery electromagnetic eigenmode. As shown in FIG. 8, this embodiment has a larger that quarter wavelength beam entrance opening 808 which functions as the entrance for the velocity vector-modulated electron beam.

Figure 9:
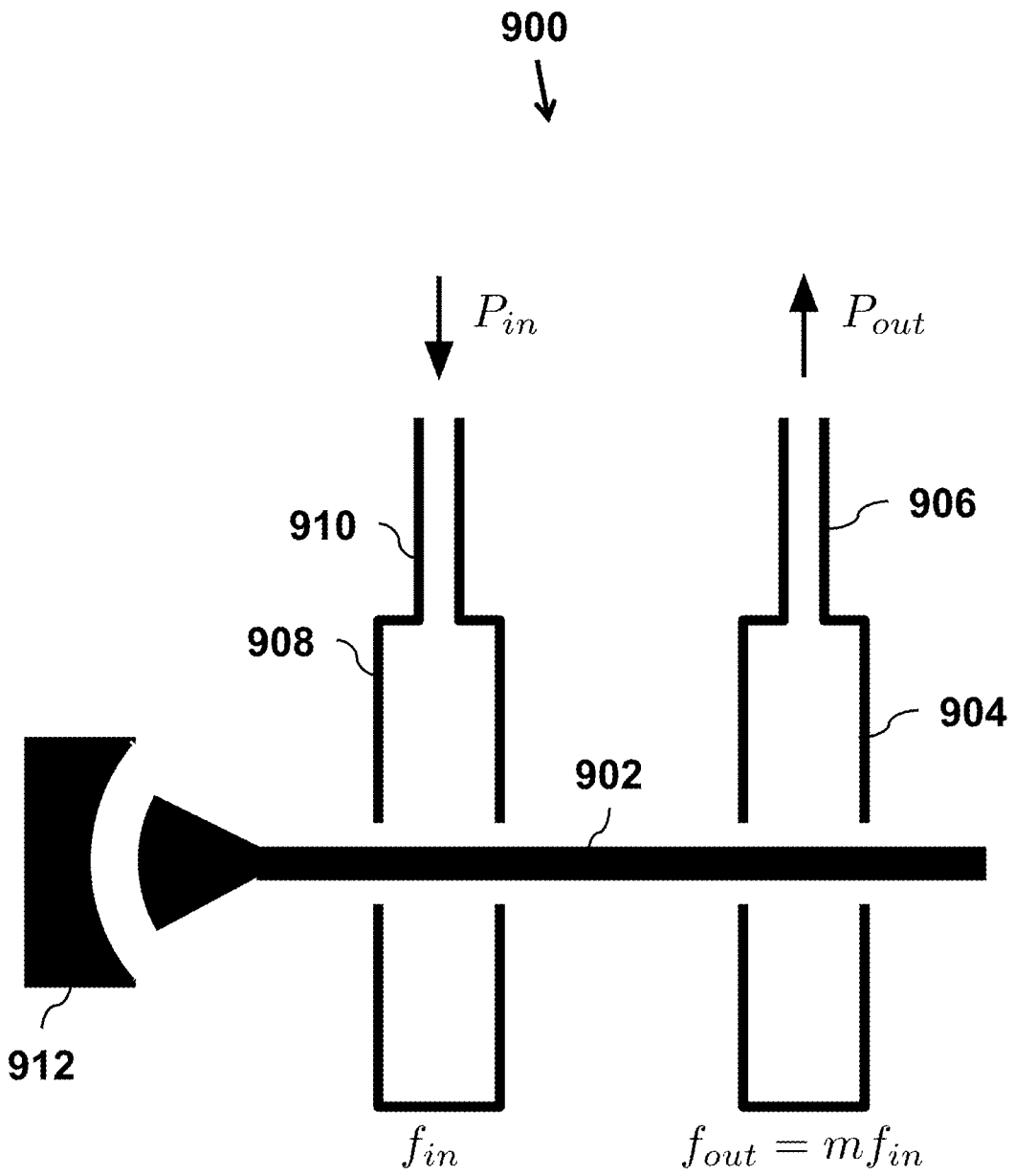
FIG. 9 is a schematic representation of an embodiment of the invention configured as a frequency multiplication apparatus.

FIG. 9 illustrates another embodiment configured as a frequency multiplication apparatus 900. It includes and electron gun 912 that can emit an electron beam 902, an output whispering gallery mode resonator 904 sized to support two orthogonal eigenmodes at the output frequency of interest $f_{out}$, and coupled to an output waveguide 906, and a input resonator 908 sized to support two orthogonal eigenmodes at the m-th subharmonic of the output frequency of interest $$f_{in} = \frac{f_{out}}{m},$$

and coupled to an input waveguide 910.

The frequency multiplication apparatus 900 functions to generate high frequency radiation at a frequency that is the m-th harmonic of the input excitation frequency. An electron beam 902 originating from an electron gun 912 is velocity-vector modulated in an input resonator 908. The input resonator 908 is sized to support two degenerate orthogonal eigenmodes with the specific field configuration required in the specific embodiment, at frequency $f_{in}$. The two degenerate orthogonal eigenmodes have $m_{in}$ azimuthal variations. The input resonator 908 is coupled to an input waveguide 910, in such a way that the two orthogonal eigenmodes are coupled with a 90° phase difference, appearing as a rotating electromagnetic wave. The fields of this rotating electromagnetic wave have an azimuthal dependence of the form $e^{-j2\pi f_{in}+m_{in}\Phi}$, where $\phi$ is the azimuthal angle. The angular phase velocity of this rotating electromagnetic wave is $$\omega_{ph}^{in} = \frac{2\pi f_{in}}{m_{in}}.$$

The electron beam 902 drifts after interacting with the field inside the input resonator 908, and in the end interacts with the field inside the whispering gallery mode resonator 904. The whispering gallery mode resonator 904 is sized to support two degenerate orthogonal eigenmodes with the specific field configuration required in the specific embodiment, at frequency $f_{out}=mf_{in}$. The two degenerate orthogonal eigenmodes have $m_{out}=m\cdot m_{in}$ azimuthal variations. The whispering gallery mode resonator 904 is coupled to an output waveguide 906, in such a way that the two orthogonal eigenmodes are coupled with a 90° phase difference, appearing as a rotating electromagnetic wave. The fields of this rotating electromagnetic wave have an azimuthal dependence of the form $e^{-j2\pi f_{in}+m_{in}\phi}$, where $\phi$ is the azimuthal angle. The angular phase velocity of this rotating electromagnetic wave is $$\omega_{ph}^{out}=\frac{2\pi f_{out}}{m_{out}}=\frac{2\pi f_{in}}{m_{in}}=\omega_{ph}^{in}.$$

Because the phase velocity of the rotating electromagnetic wave in both the input resonator 908 and whispering gallery mode resonator 904 match, power is extracted from the electron beam 902 inside the whispering gallery mode resonator 904.

Figure 10:
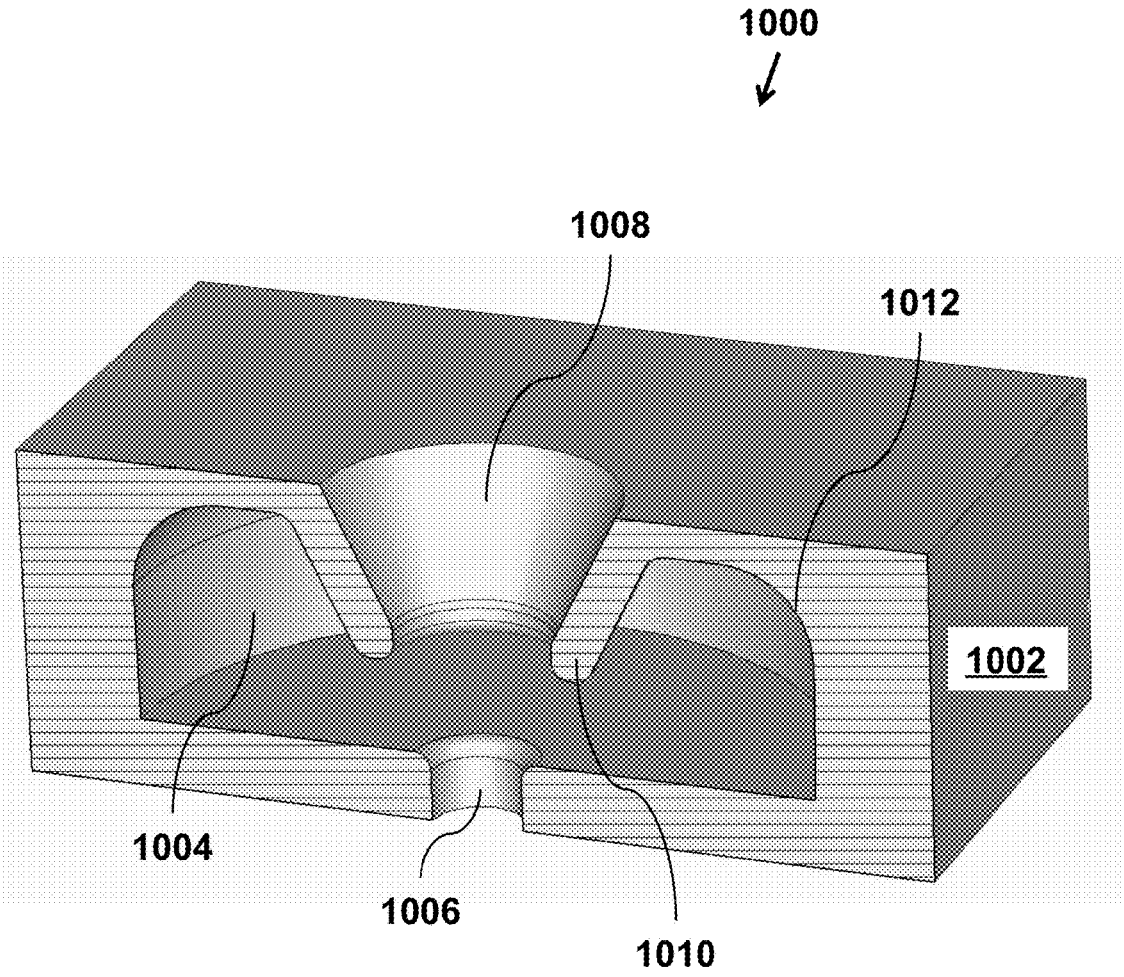
FIG. 10 is a cross-sectional view of a deflecting resonator with a single nose cone, according to the embodiment of FIG. 2.
Figure 11:
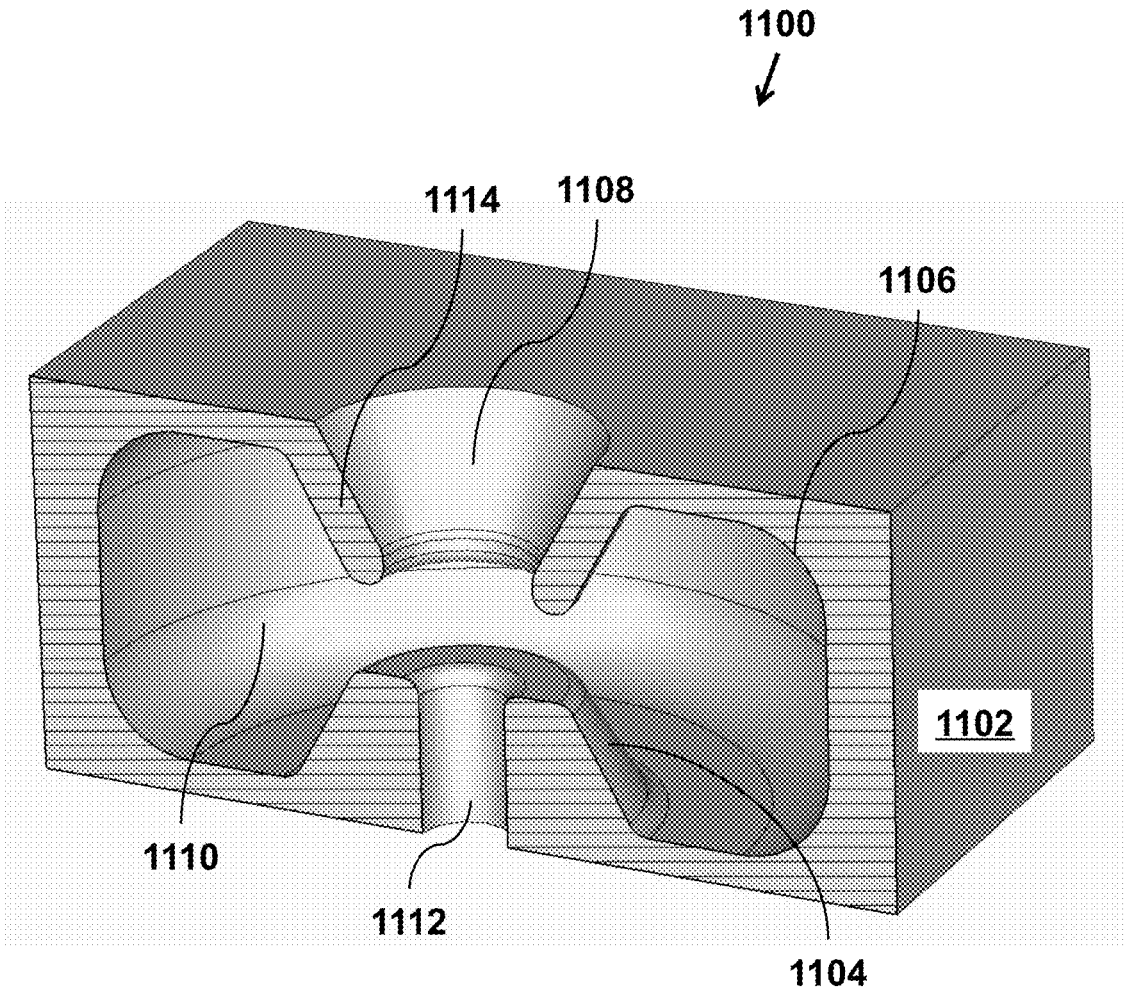
FIG. 11 is a cross-sectional view of a deflecting resonator with a double nose cones, according to the embodiment of FIG. 2.
Figure 12:
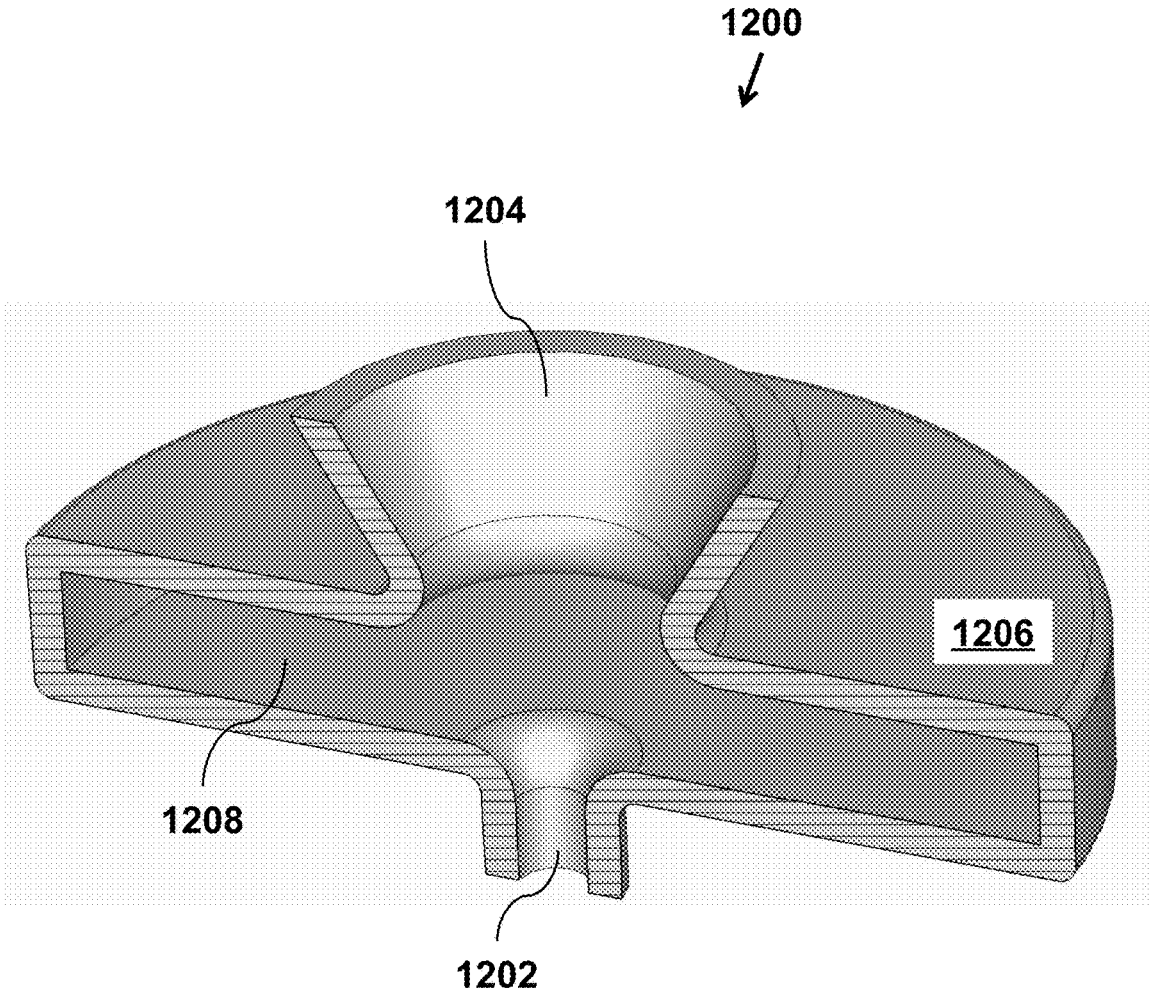
FIG. 12 is a cross-sectional view of a pillbox deflecting resonator, according to the embodiment of FIG. 2.

FIG. 10, FIG. 11, and FIG. 12 illustrate different implementations of deflecting resonators that may be used in embodiments of the invention. FIG. 10 shows a deflecting resonator 1000 that includes a solid piece of metallic material 1002, an input beam pipe 1006 for the electron beam to enter the deflecting resonator 1000, an output cone pipe 1008 for the deflected electron beam to exit the deflecting resonator 1000 without hitting the walls of the deflecting resonator 1000, an output nose cone 1010 to enhance the electromagnetic field near the interaction region, and an edge rounding 1012 to additionally enhance the electromagnetic field near the interaction region.

As shown in FIG. 11, another embodiment of a deflecting resonator 1100, comprises a solid piece of metallic material 1102, an input nose cone 1104 to enhance the electromagnetic field near the interaction region. It also includes edge rounding 1106, an output cone pipe 1108, deflecting inner resonator space 1110, input beam pipe 1112, and output nose cone 1114.

As shown in FIG. 12, another embodiment of a deflecting resonator 1200 comprises an input beam pipe 1202 for the electron beam to enter the deflecting resonator 1200, an output cone pipe 1204 for the deflected electron beam to exit the deflecting resonator 1200 without hitting the walls of the deflecting resonator 1200. Also included are metal material 1206 and deflecting inner resonator space 1208.

Each deflecting resonator described in FIG. 10, FIG. 11, and FIG. 12 functions to modulate the direction of the electron beam, by circularly deflecting the electron beam. deflecting resonator is sized to support two degenerate orthogonal eigenmodes with the specific field configuration required in the specific embodiment, at frequency $f_{in}$. The deflecting resonator is preferably sized to support two degenerate transverse electric $TE_{11}$ eigenmodes. The deflecting resonator is preferably sized to support two degenerate transverse magnetic $TM_{11}$ eigenmodes. The boundaries of the deflecting resonator are preferably formed by a solid piece of metallic material, while the deflecting resonator inner space is evacuated space. The solid piece of metallic material may be made of Oxygen-Free, Electronic-Grade Copper, Molybdenum, or Glidcop.

Figure 13:
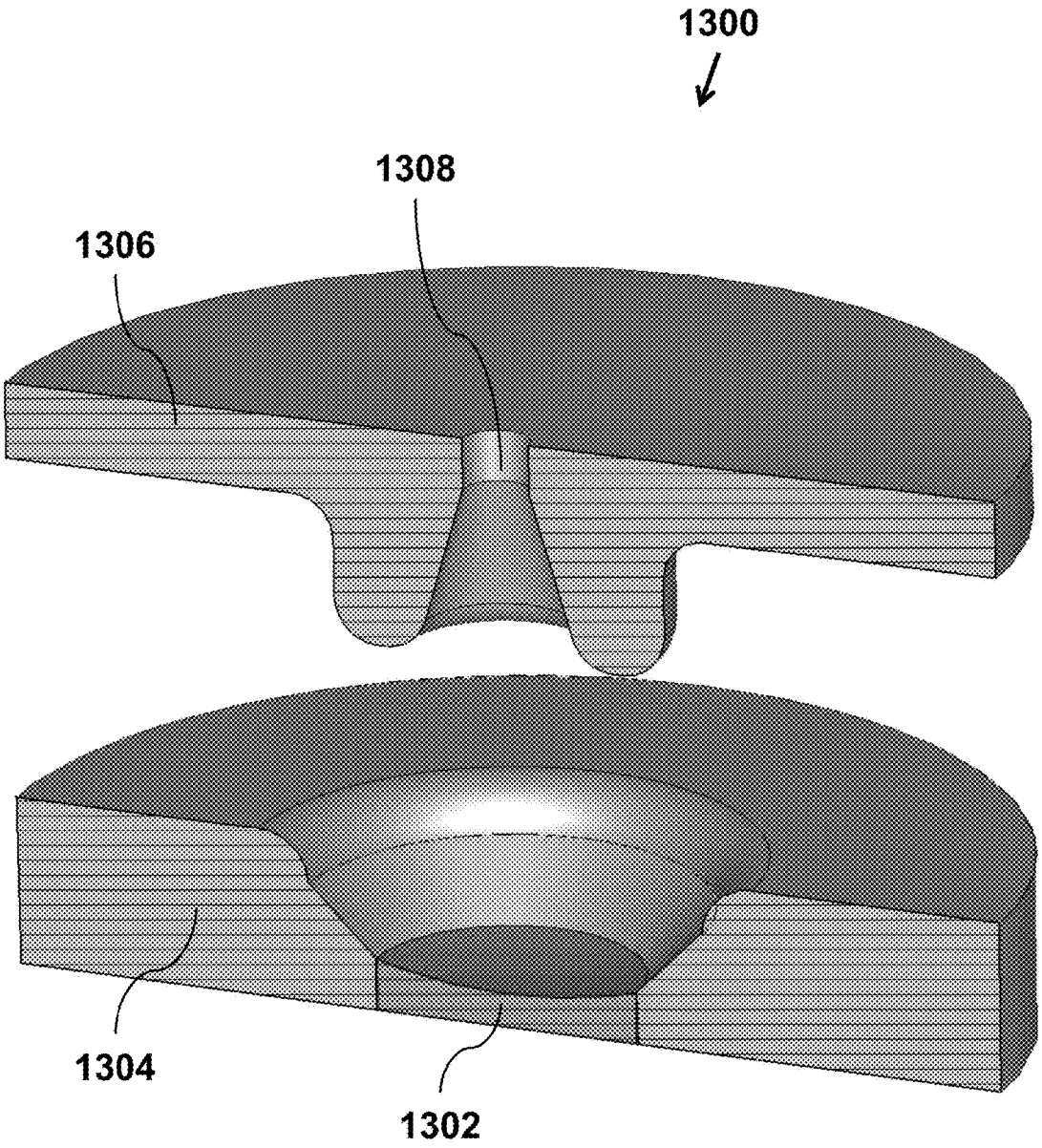
FIG. 13 is a cross-sectional view of an axial electron gun, according to the embodiment of FIG. 2.

As shown in FIG. 13, the axial electron gun 1300 preferably comprises: an axial cathode 1302 that is heated to a high temperature and functions as the source of electrons, a axial focus electrode 1304, and an axial anode electrode 1306. The axial electron gun 1300 functions to generate an electron beam. The axial anode electrode 1306 further comprises an axial beam pipe 1308 for the electrons to be extracted out of the axial electron gun 1300. The axial cathode 1302, axial focus electrode 1304, and axial anode electrode 1306 are shaped to extract a specific amount of current from the cathode under a given voltage difference between the axial focus electrode 1304 and the axial anode electrode 1306, and compress this current into a specific cross-section at the end of the axial anode electrode 1306. The axial cathode 1302 is preferably made of porous tungsten. The axial focus electrode 1304 and axial anode electrode 1306 are preferably made of stainless steel or molybdenum.

Figure 14:
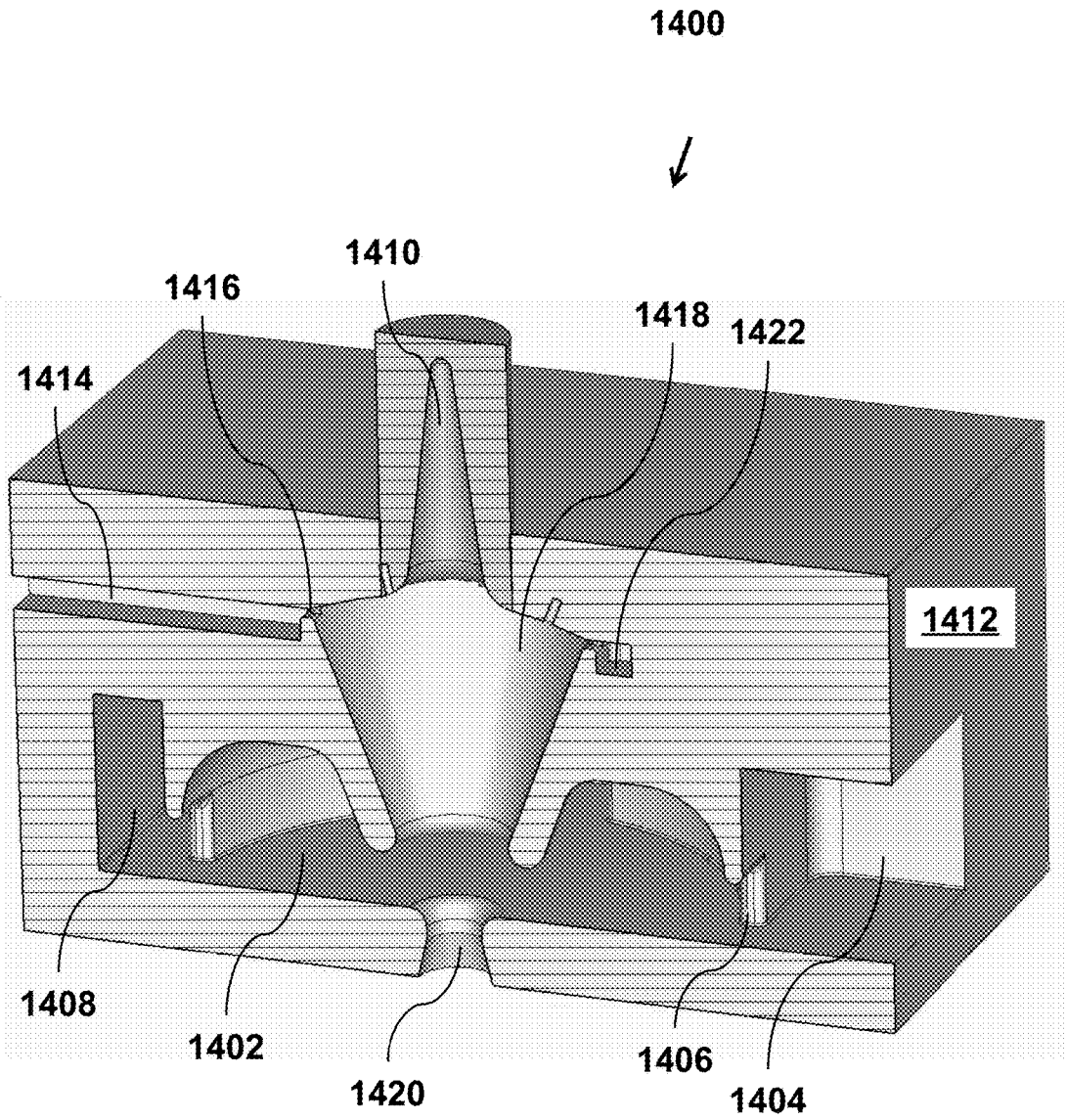
FIG. 14 is a cross-sectional view of the system for frequency multiplication using a spherical sector output resonator, further comprising a collector for the undeflected beam, according to an embodiment of the invention.

FIG. 14 shows another embodiment of a frequency multiplication apparatus 1400 which comprises a collector cone 1410. The collector cone 1410 functions to reduce the incident current density to the whispering gallery mode resonator when the deflecting resonator 1402 is not excited. The collector cone 1410 is preferably made of Oxygen-Free, Electronic-Grade Copper. The solid piece of metallic material 1412 is preferably made of Molybdenum or Glidcop. Also shown are an output waveguide 1414, input coupling aperture 1406, output coupling aperture 1416, spherical sector resonator 1418, input waveguide 1404, input beam pipe 1420, input resonator dummy feature 1408, and output resonator dummy feature 1422.

The deflecting resonator 1402 is coupled to input waveguide 1404 in such a way that the two orthogonal eigenmodes are coupled with a 90° phase difference, appearing as a rotating electromagnetic wave. The deflecting resonator 1402 is preferably coupled to an input waveguide 1404 through two orthogonally place waveguides and a hybrid coupler (detailed in FIG. 20). The deflecting resonator 1402 is preferably coupled to an input waveguide 1404 through a wrap-around mode converter (detailed in FIG. 21 and FIG. 22). The fields of this rotating electromagnetic wave have an azimuthal dependence of the form $e^{-j2\pi f_{in}+\phi}$, where $\phi$ is the azimuthal angle. The angular phase velocity of this rotating electromagnetic wave is $\omega_{ph}^{in}=2\pi f_{in}$.

Figure 15:
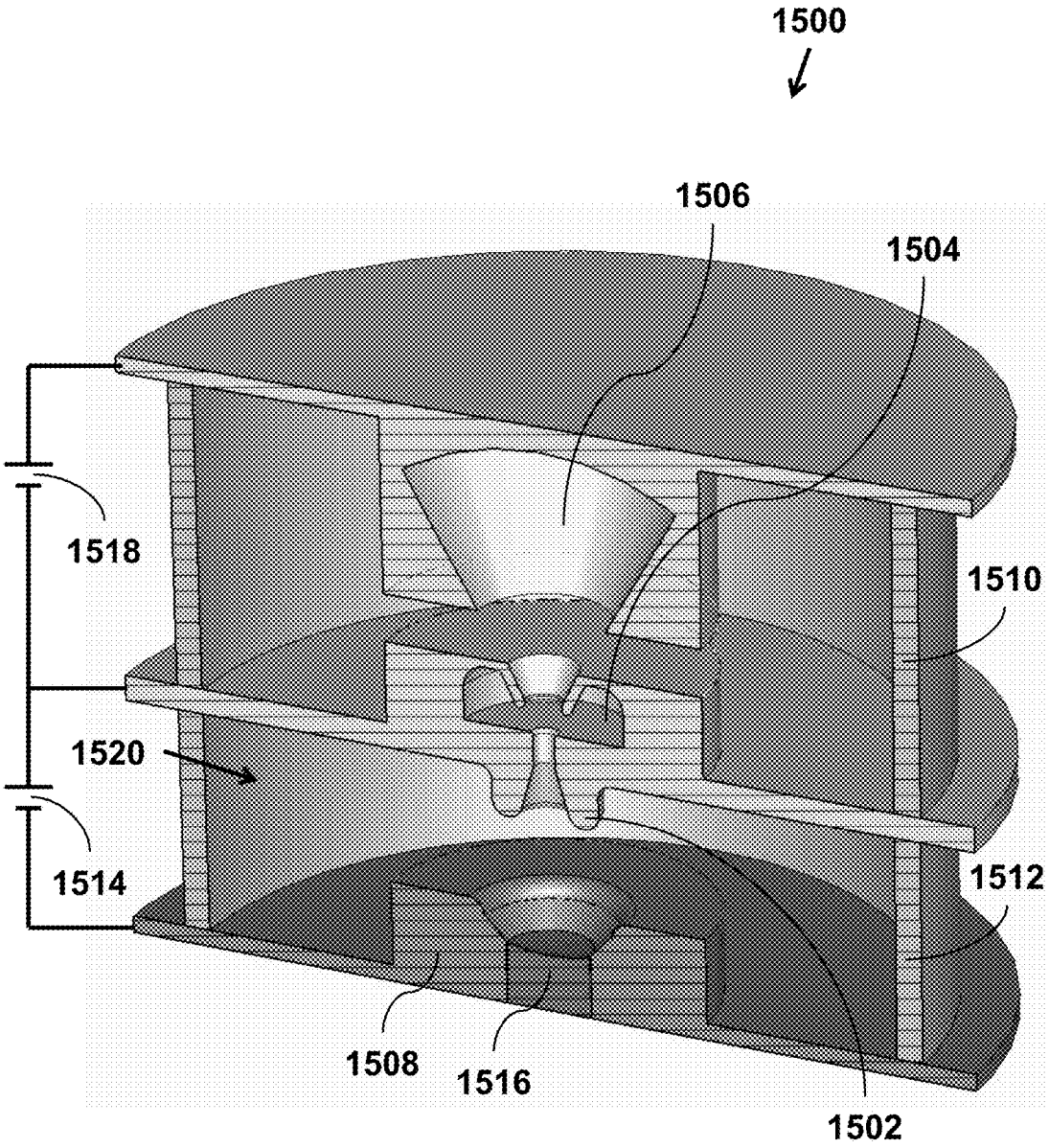
FIG. 15 is a cross-sectional view of the dual voltage system for frequency multiplication using a spherical sector output resonator, according to the embodiment of FIG. 2.

As shown in FIG. 15, in another embodiment configured as a frequency multiplication apparatus 1500, two voltage differences are used. The axial anode electrode 1502 and deflecting resonator 1504 are electrically connected to one potential level, and are electrically isolated from the whispering gallery mode resonator 1506 output resonator and axial focus electrode 1508, using two ceramic pieces 1510, 1512. An electron extraction voltage 1514 is applied between the axial focus electrode 1508 and the axial anode electrode 1502 to extract electrons from the axial cathode 1516. A second post-deflection acceleration voltage 1518 is applied between the axial anode electrode 1502 and the whispering gallery mode resonator 1506 output resonator, to further accelerate electrons after they have been deflected in the deflecting resonator 1504. In this embodiment, since a lower voltage is used to extract electrons, less input power is required at the deflecting resonator 1504 to deflect the electrons at the same angle. The second post-deflection acceleration voltage 1518 is used to increase the power in the beam after the acceleration. Also included is an axial electron gun 1520.

Figure 16:
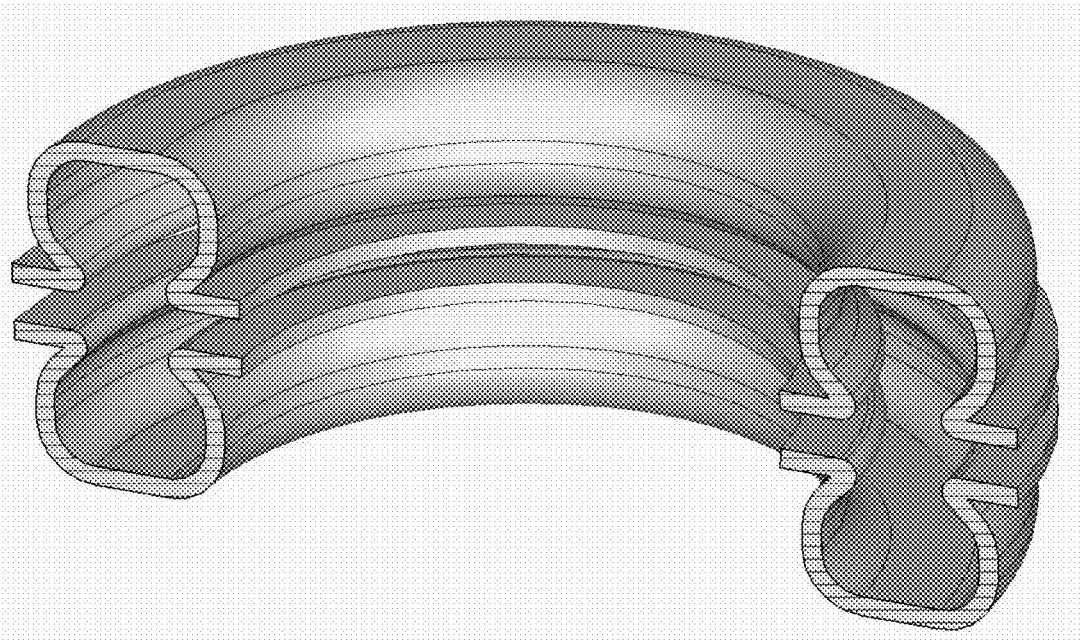
FIG. 16 is a cross-sectional view of an annular modulating resonator with nose cones, which may be used with various embodiments of the invention.
Figure 17:
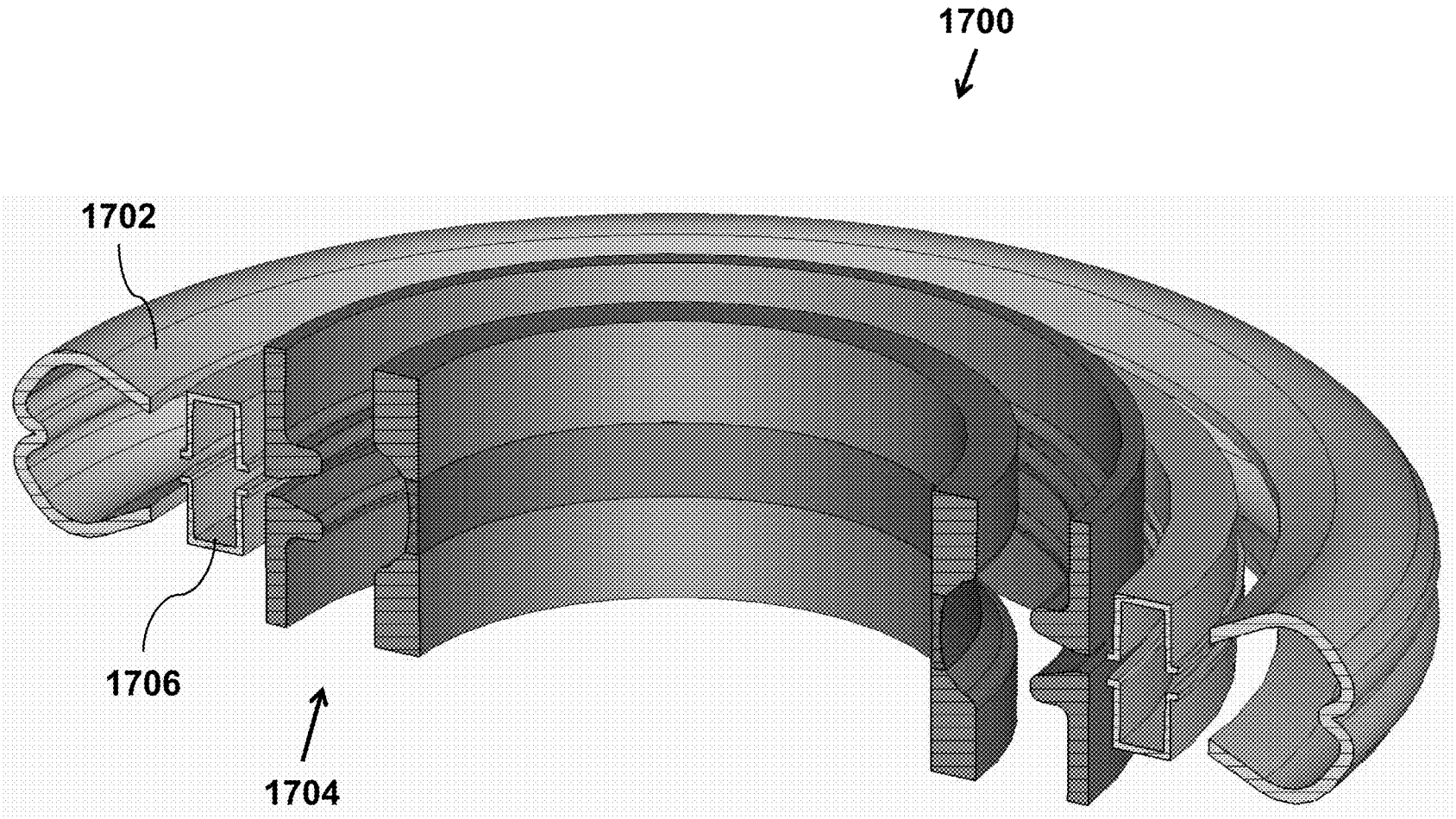
FIG. 17 is a cross-sectional view of the system for frequency multiplication using a resonator with arbitrary cross section, according to an embodiment of the invention.
Figure 18:
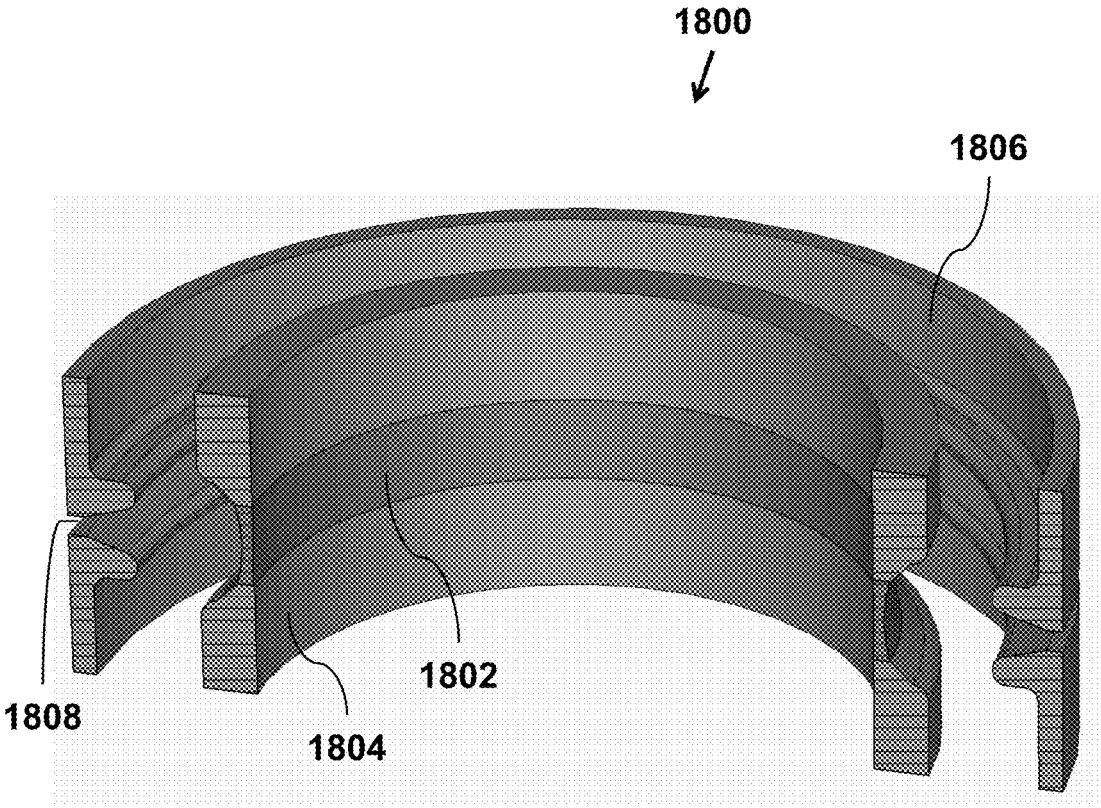
FIG. 18 is a cross-sectional view of an annular electron gun, according to various embodiments of the invention.

As shown in FIG. 17, in another embodiment of a frequency multiplication apparatus 1700, the whispering gallery mode resonator is implemented as an arbitrary cross section resonator 1702. Also shown are annular electron gun 1704 and annular ring resonator 1706. FIG. 16 shows details of an input annular ring resonator which may be implemented with this embodiment, as well as with embodiments of FIG. 4 and FIG. 6. FIG. 18 shows details of an annular electron gun 1800 which may be implemented with this embodiment, as well as with embodiments of FIG. 4 and FIG. 6. The electron gun 1800 preferably comprises an annular cathode 1802 that is heated to a high temperature and functions as the source of electrons, an annular focus electrode 1804, and an annular anode electrode 1806. The annular electron gun 1800 functions to generate an electron beam. The annular anode electrode 1806 further comprises an annular beam pipe 1808 for the electrons to be extracted out of the annular electron gun 1800. The annular cathode 1802, annular focus electrode 1804, and annular anode electrode 1806 are shaped to extract a specific amount of current from the cathode under a given voltage difference between the annular focus electrode 1804 and the annular anode electrode 1806, and compress this current into a specific cross-section at the end of the annular anode electrode 1806. The annular cathode 1802 is preferably made of porous tungsten. The annular focus electrode 1804 and annular anode electrode 1806 are preferably made of stainless steel or molybdenum.

Figure 19:
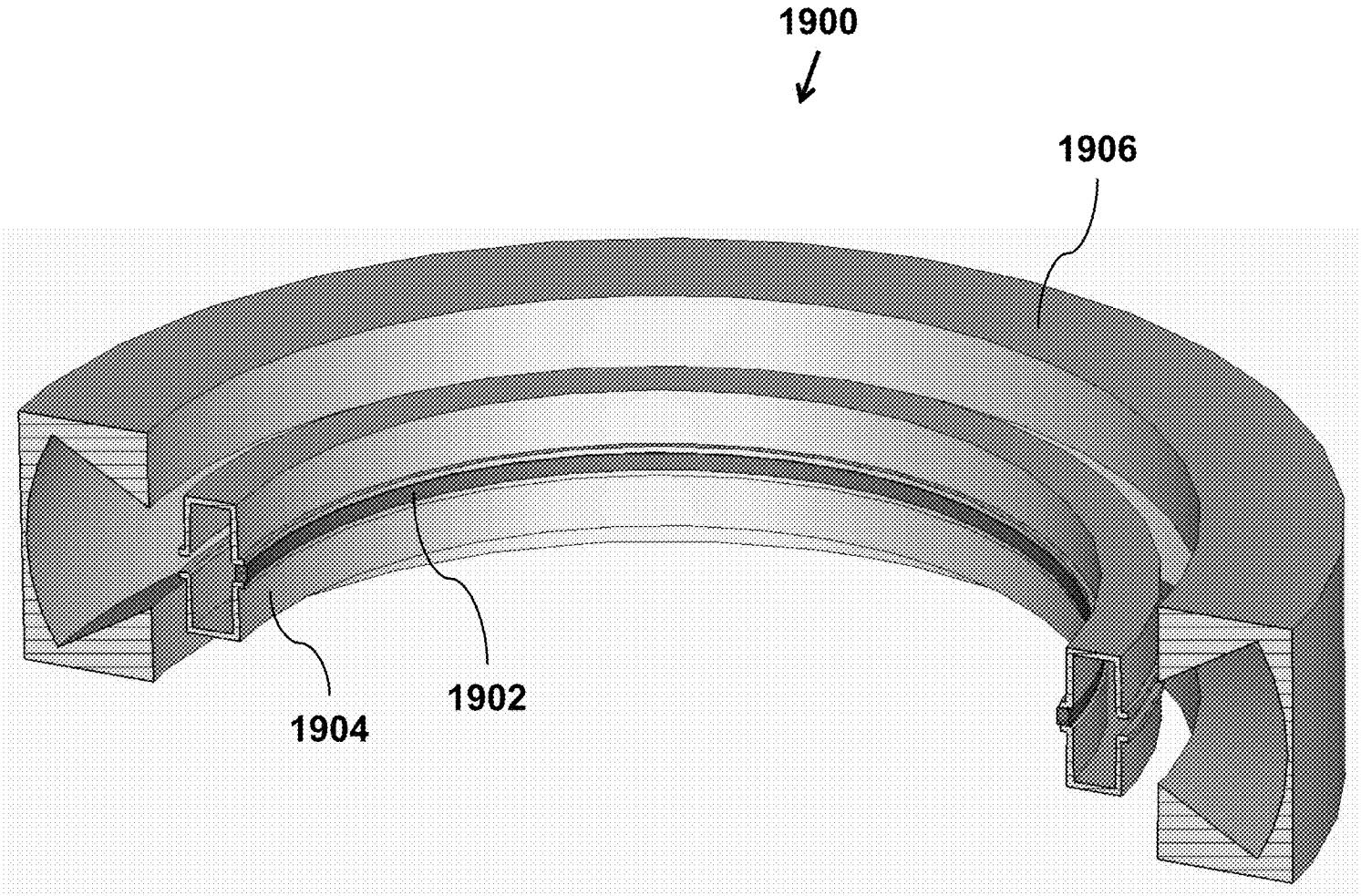
FIG. 19 is a cross-sectional view of the system for frequency multiplication using an RF gun, according to an embodiment of the invention.

FIG. 19 shows another embodiment of the invention configured as a frequency multiplication apparatus 1900. In this embodiment, the annular electron gun is replaced with an RF Gun, where the annular cathode 1902 is positioned at the edge of the annular ring resonator 1904. This combination of the annular cathode 1902 and annular ring resonator 1904 functions to generate a pre-modulated velocity vector-modulated electron beam. When the RF electric field in the annular ring resonator 1904 is radially outwards, electrons get extracted from the annular cathode 1902 and accelerated while inside the annular ring resonator 1904. Also included is a spherical shell on equator resonator 1906.

Figure 20:
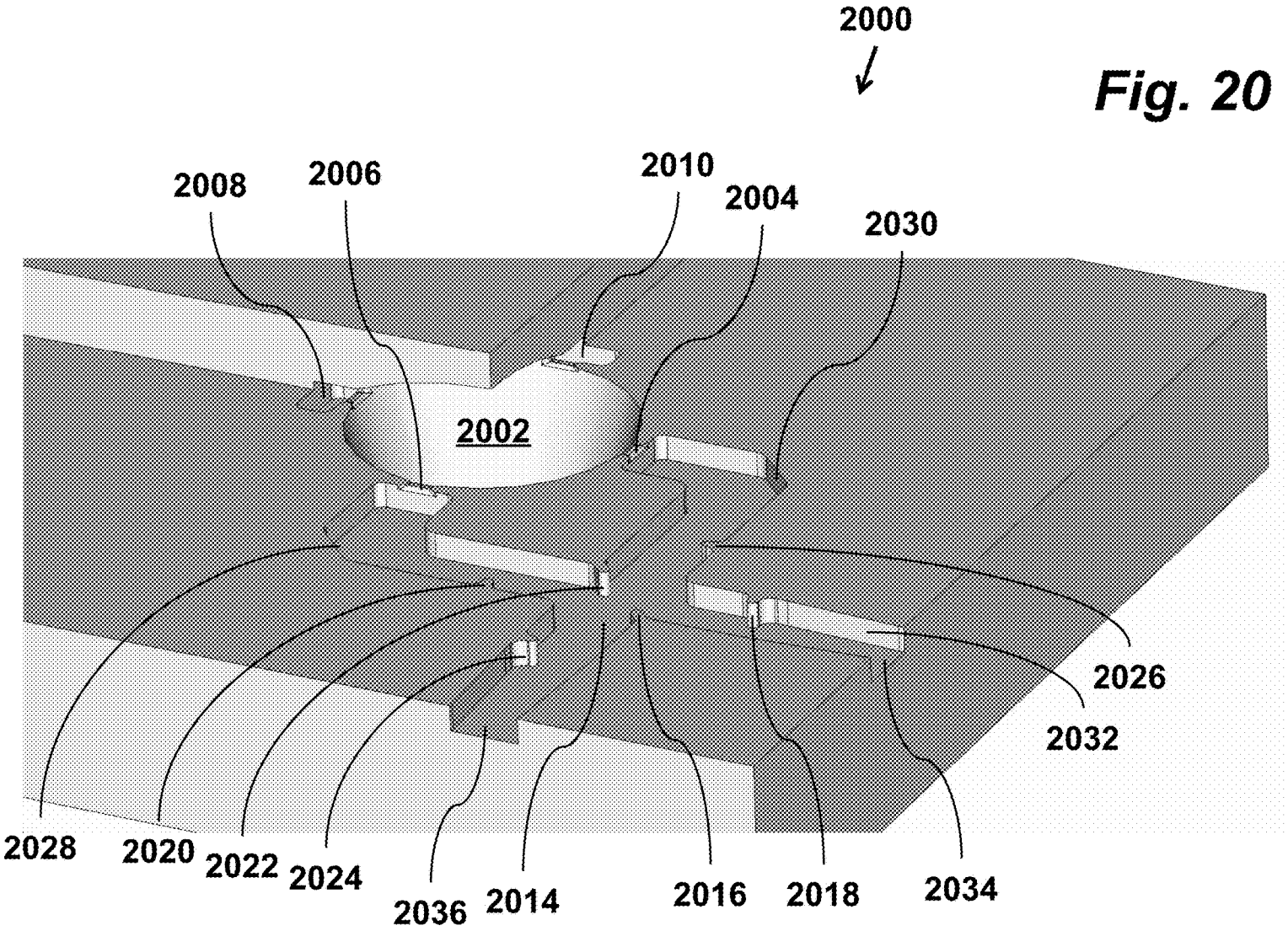
FIG. 20 is a perspective detail view showing coupling to a rotating wave via a hybrid coupler, which may be used in various embodiments of the invention.
Figure 21:
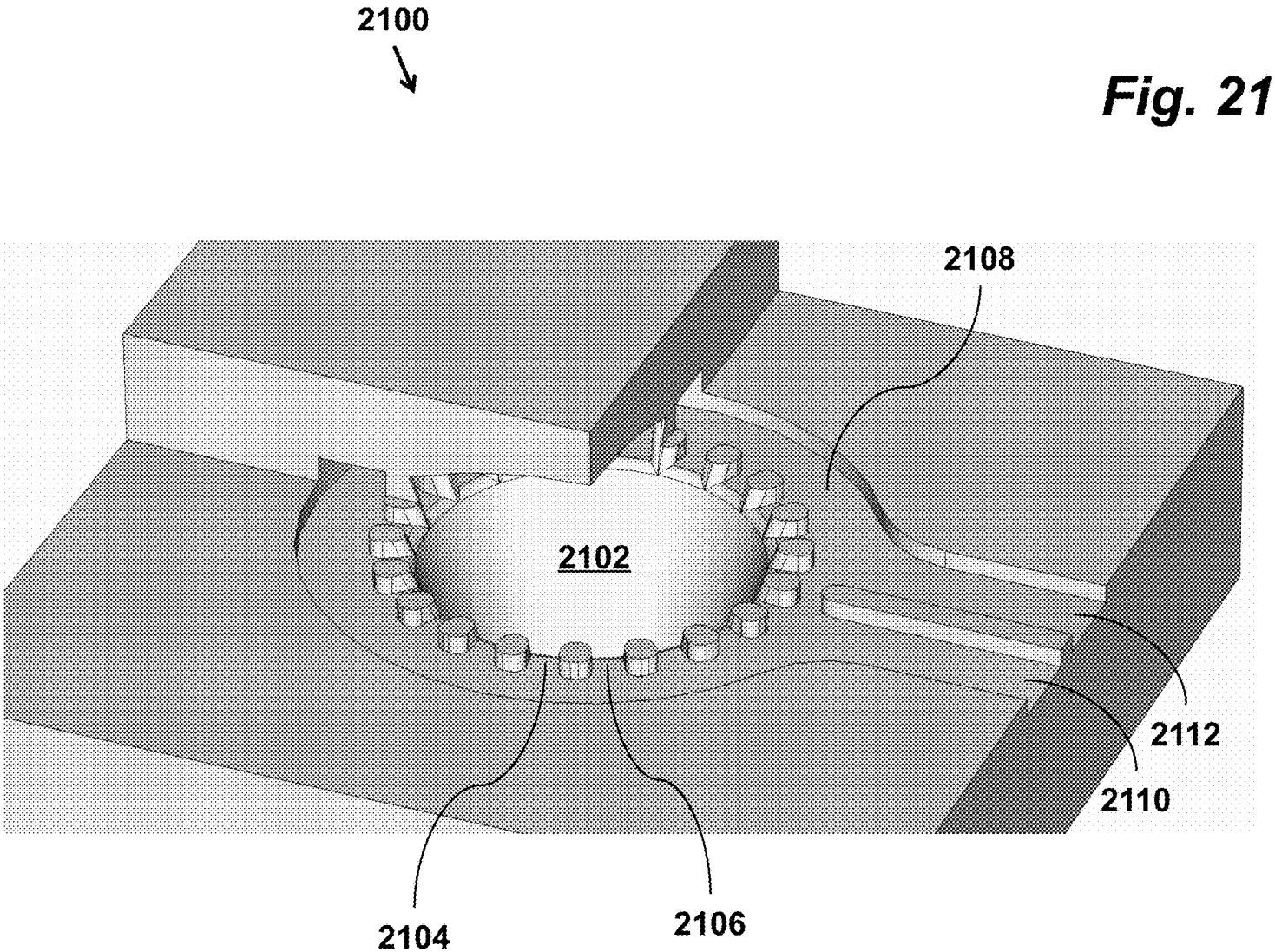
FIG. 21 is a perspective detail view showing coupling to a rotating wave via a wrap-around mode converter, which may be used in various embodiments of the invention.
Figure 22:
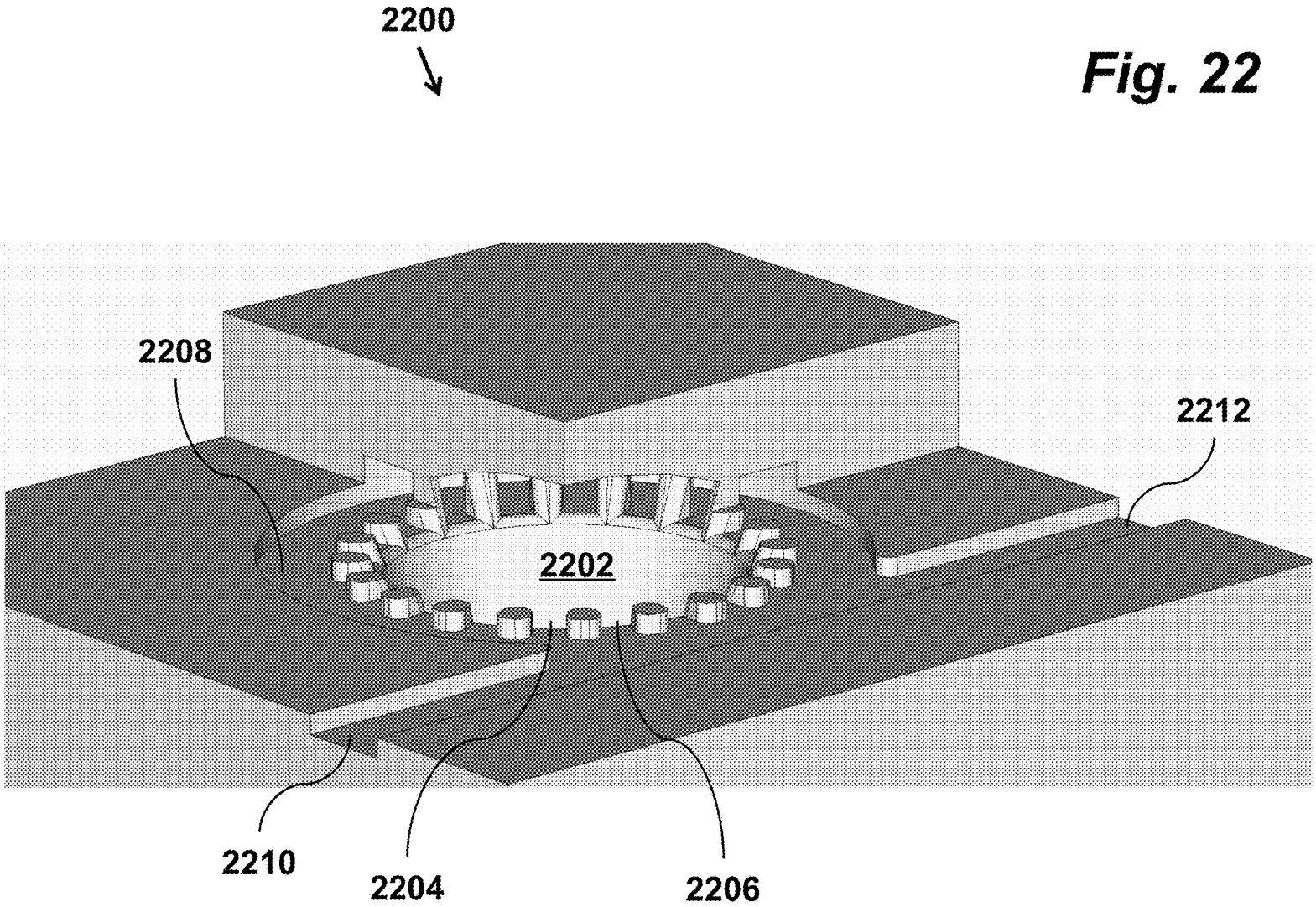
FIG. 22 is a perspective detail view showing coupling to a rotating wave via a wrap-around mode converter, which may be used in various embodiments of the invention.

FIG. 20, FIG. 21 and FIG. 22 show various coupling schemes for coupling power in and out of cavities, which may be used in embodiments of the invention.

As shown in FIG. 20, a hybrid coupler 2000 is used to couple a rotating wave in a resonator 2002 with an odd number of azimuthal variations, through two orthogonally placed coupling apertures 2004 and 2006. Two additional dummy features 2008 and 2010 are placed opposite to the coupling apertures 2004 and 2006. A dummy feature 2008 preferably is implemented as a small (compared to the wavelength of interest) waveguide piece. The hybrid coupler 2000 preferably comprises a waveguide cross 2014, matching features 2016, 2018, 2020, 2022, 2024, 2026, miter bends 2028, 2030 and a waveguide taper 2032.

The hybrid coupler 2000 functions to create a 90° phase difference between two coupling apertures 2004 and 2006, each of which couples power only to one of the two degenerate eigenmodes. The miter bends 2028, 2030 function to connect each output arm of the hybrid coupler 2000 to each of the coupling apertures 2004 and 2006. The waveguide taper 2032 functions to connect each output arm of the hybrid coupler 2000 to the waveguides 2034, 2036 used to connect the resonator 2002 to the outside world. The dummy features 2008 and 2010 function to symmetrize the fields inside the resonator 2002.

In the embodiment shown in FIG. 21, a wrap-around coupler 2100 is used to couple a rotating wave in a resonator 2102 through multiple coupling apertures 2104, 2106, each spaced quarter wavelength apart. The wrap-around mode converter 2100 preferably comprises a waveguide ring 2108 connected to the waveguides 2110, 2112, which connect the resonator 2102 to the outside world, and coupling apertures 2104, 2106 that connect the waveguide ring 2108 with the resonator 2102. The waveguide ring 2108 is sized to have the same angular phase velocity as the rotating wave in the resonator 2102. The wrap-around coupler functions to create a rotating wave inside the resonator 2102 through coupling apertures 2104, 2106.

Similarly, in the embodiment shown in FIG. 22, a wrap-around coupler 2200 is used to couple a rotating wave in a resonator 2202 through multiple coupling apertures 2204, 2206, each spaced quarter wavelength apart. The wrap-around mode converter 2200 preferably comprises a waveguide ring 2208 connected to the waveguides 2210, 2212, which connect the resonator 2202 to the outside world, and coupling apertures 2204, 2206 that connect the waveguide ring 2208 with the resonator 2202. The waveguide ring 2208 is sized to have the same angular phase velocity as the rotating wave in the resonator 2202. The wrap-around coupler functions to create a rotating wave inside the resonator 2202 through several coupling apertures 2204, 2206.

As a person skilled in the art will recognize from the previous detailed description and from the figures and claims, modifications and changes can be made to the preferred embodiments of the invention without departing from the scope of this invention defined in the following claims.

What is claimed is:

1. An apparatus for generating mm-wave electromagnetic radiation at an output frequency comprising: a) a whispering gallery mode resonator with a guiding surface, wherein the whispering gallery mode resonator has dimensions selected to support a whispering gallery electromagnetic eigenmode at the output frequency, b) an output waveguide coupled to the whispering gallery mode resonator through an aperture, and c) an electron beam source, wherein the electron beam source is designed to generate a velocity vector-modulated electron beam, wherein the electron beam source is configured such that the velocity vector-modulated electron beam travels substantially perpendicular to the guiding surface.

2. The apparatus of claim 1 wherein the whispering gallery mode resonator is a spherical sector, wherein the whispering gallery mode resonator is designed to support two orthogonal whispering gallery eigenmodes with the same output eigen-frequency, wherein the apparatus further comprises a coupler coupling the whispering gallery mode resonator to the output waveguide, wherein the coupler is designed to couple the two orthogonal whispering gallery eigenmodes with a 90 degree phase difference to the output waveguide.

3. The apparatus of claim 1 wherein the whispering gallery mode resonator is a spherical shell on equator, wherein the whispering gallery mode resonator is designed to support two orthogonal whispering gallery eigenmodes having the same output eigen-frequency, wherein the output waveguide is designed to couple the two orthogonal whispering gallery modes with a 90 degree phase difference.

4. The apparatus of claim 1 wherein the whispering gallery mode resonator is a cylindrical wedge, wherein the whispering gallery mode resonator is designed to support two orthogonal whispering gallery eigenmodes having the same output eigen-frequency, wherein the output waveguide is designed to couple the two orthogonal whispering gallery modes with a 90 degree phase difference.

5. The apparatus of claim 1 wherein the output waveguide has a rectangular cross-section with dimensions selected to support only one propagating mode at the output frequency.

6. An apparatus for generating high frequency electromagnetic radiation comprising: a whispering gallery mode resonator, having: an axis of symmetry, a guiding surface, the whispering gallery mode resonator supporting two orthogonal whispering gallery eigenmodes, an output waveguide, wherein the whispering gallery mode resonator is coupled to the output waveguide and configured to couple from the output waveguide the two orthogonal whispering gallery eigenmodes with a 90 degree phase difference an electron beam source configured to generate a velocity vector-modulated electron beam that travels substantially perpendicular to the guiding surface.

7. The apparatus of claim 6 wherein the whispering gallery mode resonator is a spherical sector, wherein the electron beam source is an axial electron gun designed to emit an initially continuous electron beam, the initially continuous electron beam initially travelling on an axis of symmetry and being velocity vector-modulated, wherein the apparatus further comprises a deflecting cavity resonator, the deflecting cavity resonator designed to support two orthogonal deflecting eigenmodes having the same input eigenfrequency, wherein the apparatus further comprises an input waveguide coupled to the deflecting cavity resonator and designed to couple the two orthogonal deflecting eigenmodes with a 90 degree phase difference.

8. The apparatus of claim 6 wherein the whispering gallery mode resonator is a spherical shell resonator on equator, wherein the electron beam source is an annular electron gun designed to emit a continuous planar sheet beam, wherein the annular electron gun is concentric with the spherical shell resonator on equator, wherein the apparatus further comprises an annular velocity modulating resonator concentric with spherical shell resonator on equator and designed to support two orthogonal radially accelerating eigenmodes, wherein the apparatus further comprises an input waveguide coupled to the annular velocity modulating resonator and designed to couple the two orthogonal radially accelerating eigenmodes with a 90 degree phase difference, resulting in a rotating wave in the annular velocity modulating resonator, the rotating wave in the annular velocity modulating resonator having the same angular phase velocity as the rotating wave in the whispering gallery mode resonator.

9. The apparatus of claim 6 wherein the whispering gallery mode resonator is a spherical shell resonator on equator, wherein the electron beam source is an annular RF electron gun concentric with the spherical shell resonator on equator, wherein the annular RF electron gun comprises an annular cathode being part of a annular velocity modulating resonator supporting two orthogonal radially accelerating eigenmodes, wherein the annular velocity modulating resonator is coupled to an input waveguide coupling the two orthogonal radially accelerating eigenmodes with a 90 degree phase difference, resulting in a rotating wave in the annular velocity modulating resonator, the rotating wave in the annular velocity modulating resonator having the same angular phase velocity as the rotating wave in the whispering gallery mode resonator.

10. The apparatus of claim 6 wherein the whispering gallery mode resonator is a cylindrical wedge resonator on equator, wherein the electron beam source is an annular electron gun designed to emit a continuous planar sheet beam, wherein the annular electron gun is concentric with the cylindrical wedge resonator, wherein the apparatus comprises an annular velocity modulating resonator concentric with the cylindrical wedge resonator, wherein the annular velocity modulating resonator is designed to support two orthogonal radially accelerating eigenmodes, wherein the apparatus comprises an input waveguide coupled to the annular velocity modulating resonator and configured to couple the two orthogonal radially accelerating eigenmodes with a 90 degree phase difference, resulting in a rotating wave in the annular velocity modulating resonator, the rotating wave in the annular velocity modulating resonator having the same angular phase velocity as the rotating wave in the whispering gallery mode resonator.

11. The apparatus of claim 6 wherein the whispering gallery mode resonator is a cylindrical wedge resonator on equator, wherein the electron beam source is an annular RF electron gun concentric with the cylindrical wedge resonator, wherein the annular RF electron gun comprises an annular cathode being part of an annular velocity modulating resonator coupled to an input waveguide and designed to support two orthogonal radially accelerating eigenmodes, wherein the annular velocity modulating resonator is coupled to an input waveguide designed to couple the two orthogonal radially accelerating eigenmodes with a 90 degree phase difference, resulting in a rotating wave in the annular velocity modulating resonator, the rotating wave in the annular velocity modulating resonator having the same angular phase velocity as the rotating wave in the whispering gallery mode resonator.

12. An apparatus for generating high frequency electromagnetic radiation comprising: an electron source generating a pencil electron beam, an input waveguide, a deflecting cavity resonator positioned on an axis of symmetry, having beam pipes for the electron beam to enter and exit the deflecting cavity resonator, wherein the deflecting cavity resonator is designed to support two orthogonal deflecting eigenmodes having the same input eigen-frequency, wherein the deflecting cavity resonator is coupled to the input waveguide, wherein the input waveguide couples the two orthogonal deflecting eigenmodes with a 90 degree phase difference, resulting in a rotating wave in the deflecting cavity resonator, an output waveguide, a whispering gallery mode resonator, positioned along the axis of symmetry after the deflecting cavity resonator, wherein the whispering gallery mode resonator has a guiding surface and is designed to support two orthogonal whispering gallery eigenmodes having the same output eigenfrequency, wherein the whispering gallery mode resonator is coupled to the output waveguide, wherein the output waveguide is designed to couple the two orthogonal whispering gallery eigenmodes with a 90 degree phase difference, resulting in a rotating wave in the whispering gallery mode resonator, the rotating wave in the deflecting cavity resonator having the phase velocity as the rotating wave in the whispering gallery mode resonator, an electron beam source designed to produce an initially continuous electron beam, initially travelling on the axis of symmetry, through the deflecting cavity resonator.

13. The apparatus of claim 12 wherein the opening for the electron beam to exit the deflecting cavity resonator is formed by nose cones, wherein the whispering gallery mode resonator is a spherical sector resonator formed between the nose cones and a spherical shell.

14. The apparatus of claim 12 wherein the opening for the electron beam to exit the deflecting cavity resonator is formed by nose cones, wherein the whispering gallery mode resonator is a conical piece of an abstract cross-section shell formed between the nose cones and an abstract surface, symmetric by the axis of symmetry.

* * * * *